US009949354B2

(12) United States Patent
Saito et al.

(10) Patent No.: US 9,949,354 B2
(45) Date of Patent: Apr. 17, 2018

(54) EXTREME UV LIGHT GENERATION APPARATUS AND METHOD

(71) Applicant: Gigaphoton Inc., Tochigi-ken (JP)

(72) Inventors: Takashi Saito, Tochigi-ken (JP); Fumio Iwamoto, Tochigi-ken (JP); Osamu Wakabayashi, Tochigi-ken (JP); Takayuki Yabu, Tochigi-ken (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 14/879,754

(22) Filed: Oct. 9, 2015

(65) Prior Publication Data

US 2016/0037616 A1 Feb. 4, 2016

Related U.S. Application Data

(63) Continuation of application No. PCT/JP2014/063376, filed on May 20, 2014.

(30) Foreign Application Priority Data

May 21, 2013 (JP) ..... 2013-106815

(51) Int. Cl.
*H05G 2/00* (2006.01)

(52) U.S. Cl.
CPC ..... *H05G 2/008* (2013.01); *H05G 2/003* (2013.01); *H05G 2/005* (2013.01); *H05G 2/006* (2013.01)

(58) Field of Classification Search
USPC ..... 250/423 R, 493.1, 504 R
See application file for complete search history.

(56) References Cited

U.S. PATENT DOCUMENTS

| | | | | |
|---|---|---|---|---|
| 7,372,056 | B2 * | 5/2008 | Bykanov | H05G 2/001 250/495.1 |
| 8,497,489 | B2 * | 7/2013 | Yabu | G03F 7/70033 250/492.1 |
| 2006/0192154 | A1 * | 8/2006 | Algots | H05G 2/003 250/504 R |
| 2007/0001130 | A1 * | 1/2007 | Bykanov | H05G 2/001 250/493.1 |

(Continued)

FOREIGN PATENT DOCUMENTS

| | | | |
|---|---|---|---|
| JP | 2005346962 | A | 12/2005 |
| JP | 2008078031 | A | 4/2008 |

(Continued)

OTHER PUBLICATIONS

International Search Report and International Search Opinion for PCT/JP2014/063376 dated Aug. 5, 2014.

*Primary Examiner* — Bernard Souw
(74) *Attorney, Agent, or Firm* — Studebaker & Brackett PC

(57) ABSTRACT

An extreme ultraviolet light generation apparatus includes a target supplier configured to output a target into a chamber as a droplet, the target generating extreme ultraviolet light when being irradiated with a laser beam in the chamber; a droplet measurement unit configured to measure a parameter for a state of the droplet outputted into the chamber; a pressure regulator configured to regulate a pressure in the target supplier in which the target is accommodated; and a target generation controller configured to control the pressure regulator, based on the parameter measured by the droplet measurement unit.

18 Claims, 20 Drawing Sheets

(56) References Cited

U.S. PATENT DOCUMENTS

| | | | | |
|---|---|---|---|---|
| 2007/0228301 | A1* | 10/2007 | Nakano | H01J 49/027 250/504 R |
| 2010/0213272 | A1* | 8/2010 | Yabu | G03F 7/70033 239/102.1 |
| 2010/0258747 | A1* | 10/2010 | Vaschenko | G03F 7/70033 250/504 R |
| 2010/0294958 | A1* | 11/2010 | Hayashi | H05G 2/003 250/504 R |
| 2011/0101863 | A1* | 5/2011 | Komori | G03F 7/70033 315/111.41 |
| 2011/0310365 | A1* | 12/2011 | Yabu | G03F 7/70033 355/30 |
| 2012/0286176 | A1* | 11/2012 | Rajyaguru | H05G 2/005 250/504 R |
| 2012/0292527 | A1 | 11/2012 | Fomenkov et al. | |
| 2013/0026393 | A1* | 1/2013 | Abe | H05G 2/005 250/504 R |
| 2013/0032640 | A1 | 2/2013 | Yabu et al. | |
| 2014/0253716 | A1* | 9/2014 | Saito | H05G 2/006 348/87 |
| 2015/0146182 | A1* | 5/2015 | Van Schoot et al. | G03F 7/70033 355/67 |
| 2016/0234920 | A1* | 8/2016 | Suzuki | H05G 2/003 |

FOREIGN PATENT DOCUMENTS

| | | | |
|---|---|---|---|
| JP | 2008532286 | A | 8/2008 |
| JP | 2010166041 | A | 7/2010 |
| JP | 2013030546 | A | 2/2013 |
| JP | 2013037787 | A | 2/2013 |

* cited by examiner

PROCESS FOR CONTROLLING TARGET GENERATION (S4)

CALCULATION OF DIAMETER OF DROPLET (S609)

IMAGE OF SHADOW OF DROPLET

CALCULATION OF POSITION OF DROPLET (S709)

IMAGE OF SHADOW OF DROPLET

PROCESS FOR CONTROLLING TARGET GENERATION (S4)

CALCULATION OF TRAVELING SPEED OF DROPLET (S909)

EXTREME UV LIGHT GENERATION APPARATUS AND METHOD

CROSS-REFERENCES TO RELATED APPLICATIONS

This application claims the benefit of Japanese Patent Application No. 2013-106815, filed May 21, 2013, which is incorporated herein by reference.

BACKGROUND

1. Technical Field

The present invention relates to an extreme ultraviolet (EUV) light generation apparatus.

2. Related Art

In recent years, as semiconductor processes become finer, transfer patterns for use in photolithographies of semiconductor processes have rapidly become finer. In the next generation, microfabrication at 70 nm to 45 nm, further, microfabrication at 32 nm or less would be demanded. In order to meet the demand for microfabrication at 32 nm or less, for example, it is expected to develop an exposure device in which a system for generating EUV light at a wavelength of approximately 13 nm is combined with a reduced projection reflective optical system.

Three types of EUV light generation systems have been proposed, which include an LPP (laser produced plasma) type system using plasma generated by irradiating a target material with a laser beam, a DPP (discharge produced plasma) type system using plasma generated by electric discharge, and an SR (synchrotron radiation) type system using synchrotron orbital radiation.

CITATION LIST

Patent Literature

PTL1: Japanese Patent Application Laid-Open No. 2010-166041

PTL2: U. S. Patent Application Publication No. 2012/292527

PTL3: U. S. Patent Application Publication No. 2010/258747

SUMMARY

According to an aspect of the present disclosure, an extreme ultraviolet light generation apparatus may include a target supplier configured to output a target into a chamber as a droplet, the target generating extreme ultraviolet light when being irradiated with a laser beam in the chamber; a droplet measurement unit configured to measure a parameter for a state of the droplet outputted into the chamber; a pressure regulator configured to regulate a pressure in the target supplier in which the target is accommodated; and a target generation controller configured to control the pressure regulator, based on the parameter measured by the droplet measurement unit.

According to an aspect of the present disclosure, an extreme ultraviolet light generation apparatus configured to generate extreme ultraviolet light by introducing a laser beam and irradiating a target with the laser beam may include a chamber into which the laser beam is introduced; a target supplier configured to output the target into the chamber as a droplet by applying a pressure to the target; a droplet measurement unit configured to measure a parameter for a state of the droplet; a pressure regulator connected to the target supplier and configured to regulate the pressure; and a target generation controller connected to the droplet measurement unit and the pressure regulator, and configured to control the pressure based on the parameter.

According to an aspect of the present disclosure, an extreme ultraviolet light generation apparatus may include a target supplier configured to output a target into a chamber as a droplet, the target generating extreme ultraviolet light when being irradiated with a laser beam in the chamber; and a droplet measurement unit configured to measure a parameter for a state of the droplet outputted into the chamber, wherein emission of the laser beam to the droplet is controlled based on the measured parameter.

BRIEF DESCRIPTION OF THE DRAWINGS

Hereinafter, selected embodiments of the present disclosure will be described with reference to the accompanying drawings by way of example.

DESCRIPTION OF EXEMPLARY EMBODIMENTS

<Contents>

Figure 1:
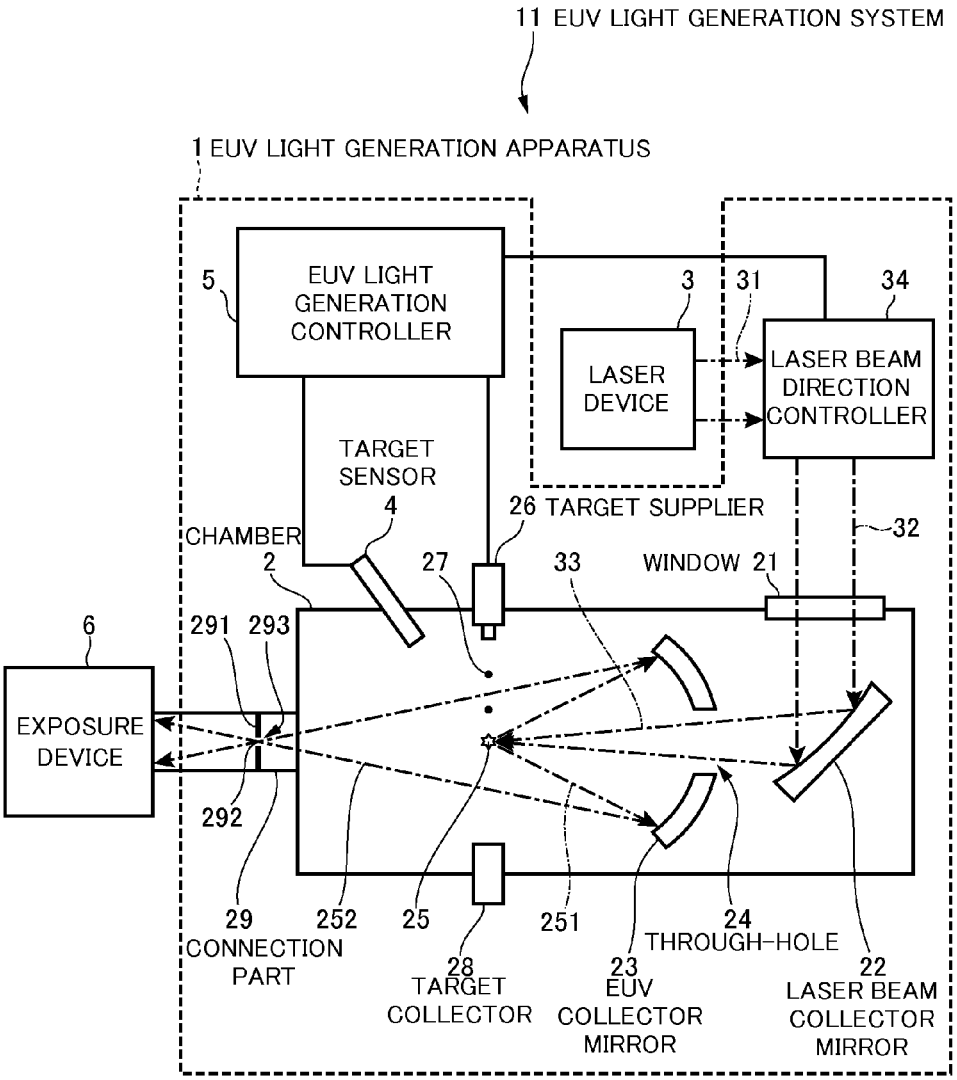
FIG. 1 schematically shows the configuration of an exemplary LPP type EUV light generation system.

1. Overview
2. Description of terms
3. Overview of the EUV light generation system
3.1 Configuration
3.2 Operation
4. EUV light generation apparatus including a target generation device
4.1 Configuration
4.2 Operation
4.3 Problem
5. Target generation system included in the EUV light generation apparatus according to Embodiment 1
5.1 Configuration
5.2 Operation
5.3 Effect
6. Target generation system included in the EUV light generation apparatus according to Embodiment 2
6.1 Configuration
6.2 Operation
6.3 Effect
7. Target generation system included in the EUV light generation apparatus according to Embodiment 3
7.1 Configuration
7.2 Operation
7.3 Effect
8. Target generation system included in the EUV light generation apparatus according to a modification of a droplet forming mechanism
9. Target generation system included in the EUV light generation apparatus according to Embodiment 4
9.1 Configuration
9.2 Operation
9.3 Effect
10. Others
10.1 Hardware environment of each controller
10.2 Another modification Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Corresponding elements are referenced by corresponding reference numerals and characters, and therefore duplicate descriptions will be omitted.

1. Overview

The present disclosure may at least disclose the following embodiments.

An EUV light generation apparatus 1 according to the present disclosure may include a target supplier 26 configured to output into the chamber 2 a target 27 that generates EUV light when the target 27 is irradiated with a laser beam in a chamber 2, as a droplet 271; a droplet measurement unit 41 configured to measure a parameter for the state of the droplet 271 outputted into the chamber 2; a pressure regulator 721 configured to regulate the pressure in the target supplier 26 in which the target 27 is accommodated; and a target generation controller 74 configured to control the pressure regulator 721 based on the parameter measured by the droplet measurement unit 41. Therefore, the EUV light generation apparatus 1 according to the present disclosure may stabilize the state of the droplet 271 actually outputted into the chamber 2.

2. Description of Terms

"Target" refers to a substance which is introduced into the chamber and is irradiated with a laser beam. The target irradiated with the laser beam is turned into plasma and emits EUV light. "Droplet" may refer to one form of the target introduced into the chamber. "Parameter for the state of a droplet" may refer to the physical quantity representing the dynamic state of the droplet outputted from the target supplier into the chamber. Particularly, the parameter may be the size, position, speed, flow rate of the droplet traveling through the chamber, and the distance between two adjacent droplets.

3. Overview of the EUV Light Generation System 3.1 Configuration

FIG. 1 schematically shows the configuration of an exemplary LPP type EUV light generation system. The EUV light generation apparatus 1 may be used with at least one laser device 3. In the present disclosure, the system including the EUV light generation apparatus 1 and the laser device 3 may be referred to as an EUV light generation system 11. As shown in FIG. 1, and as described in detail later, the EUV light generation apparatus 1 may include a chamber 2 and a target supplier 26. The chamber 2 may be sealed airtight. The target supplier 26 may be mounted onto the chamber 2, for example, to penetrate a wall of the chamber 2. A target material to be supplied from the target supplier 26 may include, but is not limited to, tin, terbium, gadolinium, lithium, xenon, or a combination of any two or more of them.

The chamber 2 may have at least one through-hole in its wall. A window 21 may be provided on the through-hole. A pulsed laser beam 32 outputted from the laser device 3 may transmit through the window 21. In the chamber 2, an EUV collector mirror 23 having a spheroidal reflective surface may be provided. The EUV collector mirror 23 may have a first focusing point and a second focusing point. The surface of the EUV collector mirror 23 may have a multi-layered reflective film in which molybdenum layers and silicon layers are alternately laminated. The EUV collector mirror 23 may be preferably arranged such that the first focusing point is positioned in a plasma generation region 25 and the second focusing point is positioned in an intermediate focus (IF) point 292. The EUV collector mirror 23 may have a through-hole 24 formed at the center thereof so that a pulsed laser beam 33 may pass through the through-hole 24.

The EUV light generation apparatus 1 may further include an EUV light generation controller 5 and a target sensor 4. The target sensor 4 may have an imaging function and detect, for example, the presence, trajectory, position and speed of the target 27.

Further, the EUV light generation apparatus 1 may include a connection part 29 that allows the interior of the chamber 2 to be in communication with the interior of an exposure device 6. In the connection part 29, a wall 291 having an aperture 293 may be provided. The wall 291 may be positioned such that the second focusing point of the EUV collector mirror 23 lies in the aperture 293.

The EUV light generation apparatus 1 may also include a laser beam direction controller 34, a laser beam focusing mirror 22, and a target collector 28 for collecting the target 27. The laser beam direction controller 34 may include an optical element for defining the traveling direction of the laser beam and an actuator for adjusting the position or the posture of the optical element.

3.2 Operation

With reference to FIG. 1, a pulsed laser beam 31 outputted from the laser device 3 may pass through the laser beam direction controller 34, transmit through the window 21 as a pulsed laser beam 32, and then enter the chamber 2. The pulsed laser beam 32 may travel through the chamber 2 along at least one laser beam path, be reflected by the laser beam focusing mirror 22, and be applied to at least one target 27 as the pulsed laser beam 33.

The target supplier 26 may be configured to output the target 27 to the plasma generation region 25 in the chamber 2. The target 27 may be irradiated with at least one pulse of the pulsed laser beam 33. Upon being irradiated with the pulsed laser beam, the target 27 may be turned into plasma, and EUV light 251 may be emitted from the plasma together with the emission of light at different wavelengths. The EUV light 251 may be selectively reflected by the EUV collector mirror 23. An EUV light 252 reflected by the EUV collector mirror 23 may be focused onto the IF point 292, and outputted to the exposure device 6. Here, one target 27 may be irradiated with multiple pulses of the pulsed laser beam 33.

The EUV light generation controller 5 may be configured to totally control the EUV light generation system 11. The EUV light generation controller 5 may be configured to process the image data of the target 27 captured by the target sensor 4. Further, the EUV light generation controller 5 may be configured to control at least one of: the timing at which the target 27 is outputted; and the direction in which the target 27 is outputted. Furthermore, the EUV light generation controller 5 may be configured to control at least one of: the timing at which the laser device 3 oscillates; the traveling direction of the pulsed laser beam 32; and the position on which the pulsed laser beam 33 is focused. The various controls described above are merely examples, and other controls may be added as necessary.

Figure 2:
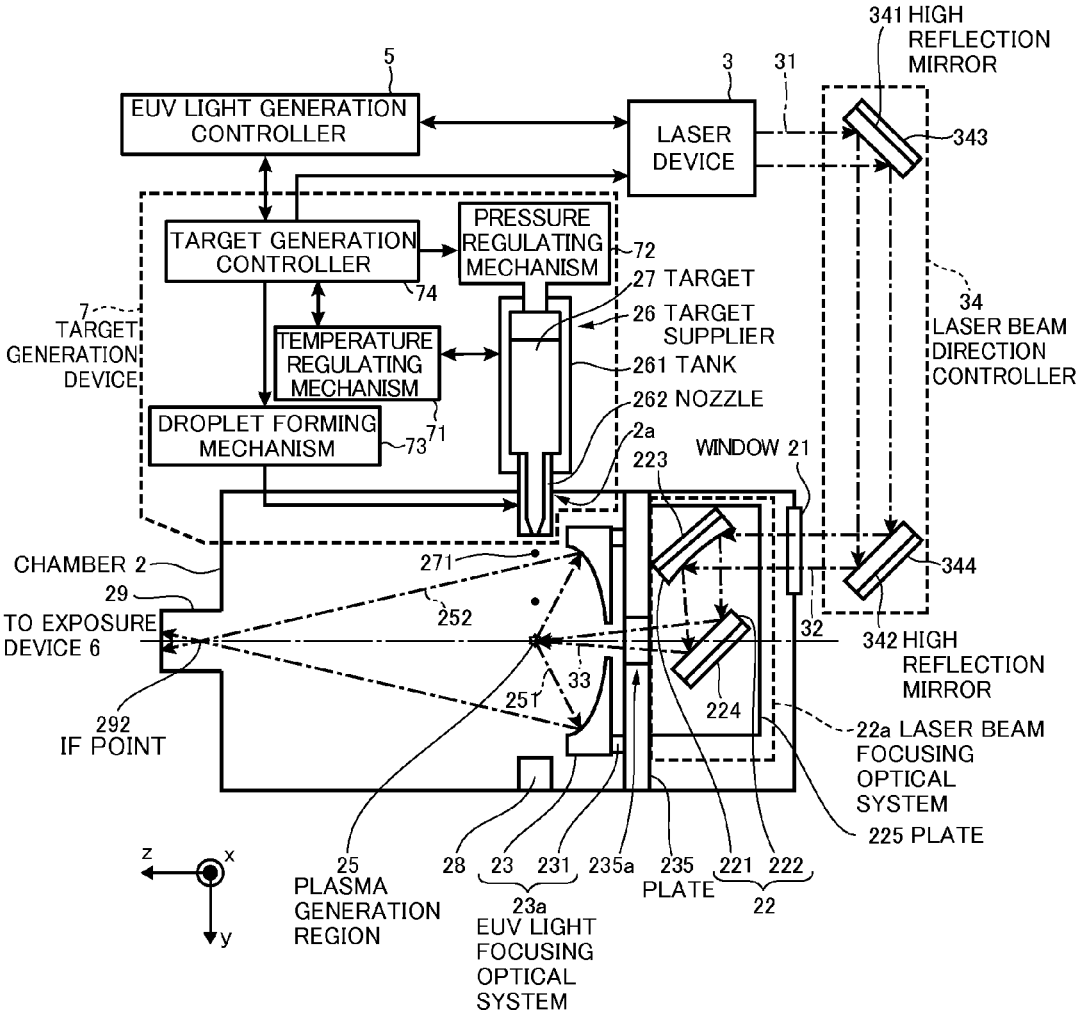
FIG. 2 shows the configuration of an EUV light generation apparatus including a target generation device.
Figure 3:
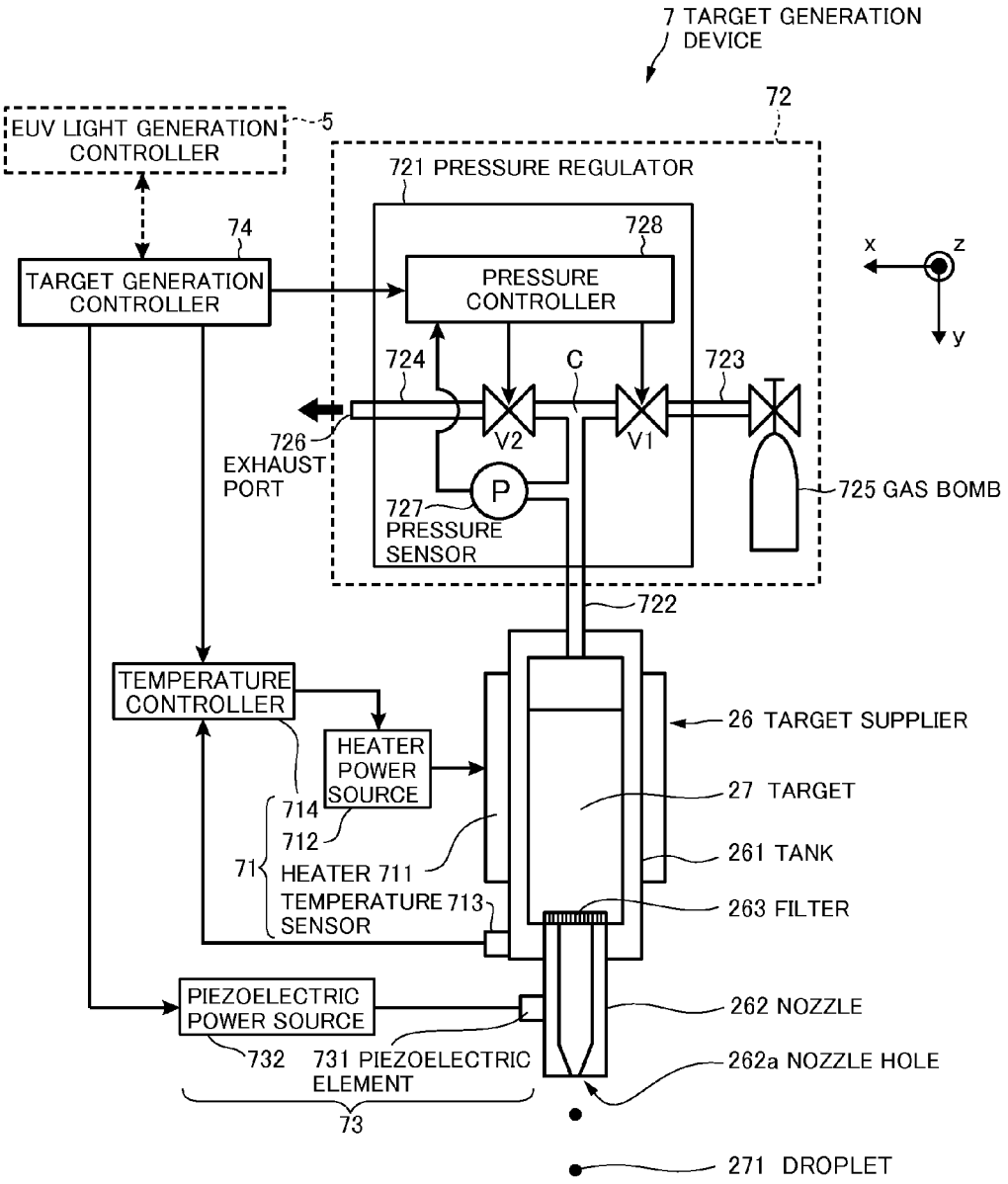
FIG. 3 shows the configuration of the target generation device including a pressure regulator.

4. EUV Light Generation Apparatus Including the Target Generation Device 4.1 Configuration With reference to FIG. 2, the configuration of the EUV light generation apparatus 1 including the target generation device 7 will be described. With reference to FIG. 3, the configuration of the target generation device 7 including the pressure regulator 721 will be described. In FIG. 2, the direction in which the EUV light 252 is directed from the chamber 2 of the EUV light generation apparatus 1 to the exposure device 6 is represented as the z-axis. The x-axis and the y-axis are orthogonal to the z-axis, and are orthogonal to one another. The same definition of these coordinate axes will be applied to the other drawings described later.

The chamber 2 of the EUV light generation apparatus 1 may be formed into, for example, a hollow spherical shape or a hollow cylindrical shape. The direction of the central axis of the cylindrical chamber 2 may be the same as the direction in which the EUV light 252 is directed to the exposure device 6. The cylindrical chamber 2 may include a target supply hole 2*a* formed on its side surface, for supplying the target 27 into the chamber 2 from outside. If the chamber 2 is formed into a hollow spherical shape, the target supply hole 2*a* may be formed on the wall surface of the chamber 2 at a position in which the window 21 and the connection portion 29 are not provided. In the chamber 2, a laser beam focusing optical system 22*a*, an EUV light focusing optical system 23*a*, the target collector 28, a plate 225 and a plate 235 may be provided.

The plate 235 may be fixed to the inner side surface of the chamber 2. A hole 235*a* that allows the pulsed laser beam 33 to pass through may be formed at the center of the plate 235 in the thickness direction of the plate 235. The opening direction of the hole 235*a* may be the same as the direction of the axis passing through the through-hole 24 and the plasma generation region 25. The EUV light focusing optical system 23*a* may be provided on one surface of the plate 235. Meanwhile, on the other surface of the plate 235, the plate 225 may be provided via a triaxial stage (not shown).

The EUV light focusing optical system 23*a* provided on the one surface of the plate 235 may include the EUV collector mirror 23 and a holder 231. The holder 231 may hold the EUV collector mirror 23. The holder 231 holding the EUV collector mirror 23 may be fixed to the plate 235.

The plate 225 provided on the other surface of the plate 235 may be changed in its position and posture by the triaxial stage. The laser beam focusing optical system 22*a* may be provided on the plate 225.

The laser beam focusing optical system 22*a* may include the laser beam collector mirror 22, a holder 223 and a holder 224. The laser beam collector mirror 22 may include an off-axis paraboloidal mirror 221 and a plane mirror 222.

The holder 223 may hold the off-axis paraboloidal mirror 221. The holder 23 holding the off-axis paraboloidal mirror 221 may be fixed to the plate 225. The holder 224 may hold the plane mirror 222. The holder 224 holding the plane mirror 222 may be fixed to the plate 225.

The off-axis paraboloidal mirror 221 may be placed to face each of the window 21 provided on the bottom surface of the chamber 2 and the plane mirror 222. The plane mirror 222 may be placed to face each of the hole 235*a* and the off-axis paraboloidal mirror 221. The positions and postures of the off-axis paraboloidal mirror 221 and the plane mirror 222 may be adjusted by changing the position and posture of the plate 225. This adjustment may be performed such that the pulsed laser beam 33, which is a reflected beam of the pulsed laser beam 32 having entered the off-axis paraboloidal mirror 221 and the plane mirror 222, is focused on the plasma generation region 25.

The target collector 28 may be positioned on the extension of the traveling direction of the droplet 271 outputted into the chamber 2.

Meanwhile, the laser beam direction controller 34, the EUV light generation controller 5 and the target generation device 7 may be provided outside the chamber 2.

The laser beam direction controller 34 may be provided between the window 21 formed on the bottom surface of the chamber 2 and the laser device 3. The laser beam direction controller 34 may include a high reflection mirror 341, a high reflection mirror 342, a holder 343 and a holder 344.

The holder 343 may hold the high reflection mirror 341. The holder 344 may hold the high reflection mirror 342. The positions and postures of the holders 343 and 344 may be changed by an actuator (not shown).

The high reflection mirror 341 may be placed to face each of the exit aperture of the laser device 3 from which the pulsed laser beam 31 exits, and the high reflection mirror 342. The high reflection mirror 342 may be placed to face each of the window 21 of the chamber 2 and the high reflection mirror 341. The positions and postures of the high reflection mirrors 341 and 342 may be adjusted by changing the positions and postures of the holders 343 and 344. This adjustment may be performed such that the pulsed laser beam 32, which is the reflected beam of the pulsed laser beam 31 having entered the high reflection mirrors 341 and 342, transmits through the window 21 formed on the bottom surface of the chamber 2.

The EUV light generation controller 5 may send/receive control signals to/from the laser device 3 and control the operation of the laser device 3. The EUV light generation controller 5 may send/receive control signals to/from the actuators of the laser beam direction controller 34 and the laser beam focusing optical system 22*a*. By this means, the EUV light generation controller 5 may adjust the traveling directions and the focusing positions of the pulsed laser beams 31 to 33. The EUV light generation controller 5 may send/receive control signals to/from the target generation controller 74 (described later) of the target generation device 7 and control the operation of the target generation device 7. Here, the hardware configuration of the EUV light generation controller 5 will be described later with reference to FIG. 20.

The target generation device 7 may be provided in the side surface side of the chamber 2. The target generation device 7 may include the target supplier 26, a temperature regulating mechanism 71, a pressure regulating mechanism 72, a droplet forming mechanism 73, and the target generation controller 74.

The target supplier 26 may include a tank 261, a nozzle 262 and a filter 263. The tank 261 may be formed into a hollow cylindrical shape. The hollow tank 261 may accommodate the target 27. At least the interior of the tank 261 accommodating the target 27 may be made of a material which is not likely to react with the target 27. The material which is not likely to react with the target 27 may be any of, for example, SiC, $SiO_2$, $Al_2O_3$, molybdenum, tungsten and tantalum.

The nozzle 262 may be provided on the bottom surface of the cylindrical tank 261. The nozzle 262 may be placed in the interior of the chamber 2 via the target supply hole 2*a* of the chamber 2. The target supply hole 2*a* may be closed by providing the target supplier 26. By this means, it is possible to isolate the interior of the chamber 2 from the atmosphere. The interior of the nozzle 262 may be made of a material which is not likely to react with the target 27.

One end of the pipe-like nozzle 262 may be fixed to the hollow tank 261. A nozzle hole 262*a* may be formed in the other end of the pipe-like nozzle 262 as shown in FIG. 3. The tank 261 provided in one end side of the nozzle 262 may be placed outside the chamber 2. Meanwhile, the nozzle hole 262*a* provided on the other end side of the nozzle 262 may be placed inside the chamber 2. The plasma generation region 25 placed inside the chamber 2 may be positioned on the extension of the direction of the central axis of the nozzle 262. The interiors of the tank 261, the nozzle 262 and the chamber 2 may communicate with each other. The nozzle hole 262*a* may be formed into a shape that allows the molten target 27 to be jetted into the chamber 2.

As shown in FIG. 3, the filter 263 may be provided in a detachably attachable manner on the end of the nozzle 262 in the tank 261 side. The interiors of the tank 261 and the nozzle 262 may communicate with one another via the filter 263. The filter 263 may have a porous structure and be made of a material which is not likely to react with the target 27. The porous filter 263 may include a number of through-holes that penetrate through the filter 263 in its thickness direction. Each of the through-holes of the filter 263 may have the size that allows the molten target 27 to pass through but does not allow impurities mixed into the target 27 to pass through. The impurities mixed into the target 27 may be the oxide of the target 27 obtained by oxidizing the target 27 with the atmospheric oxygen remaining in the tank 261 and the nozzle 262, or may be dust and so forth. The nozzle hole 262*a* of the nozzle 262 may be clogged with these impurities of the target 27. The filter 263 may allow the molten target 27 in the tank 261 to pass to the nozzle 262 and catch the impurities mixed into the target 27.

The temperature regulating mechanism 71 may regulate the temperature of the tank 261. As shown in FIG. 3, the temperature regulating mechanism 71 may include a heater 711, a heater power source 712, a temperature sensor 713 and a temperature controller 714.

The heater 711 may be fixed to the outer side surface of the cylindrical tank 261. The heater 711 fixed to the tank 261 may heat the tank 261. The heater 711 that heats the tank 261 may be connected to the heater power source 712. The heater power source 712 may supply electric power to the heater 711. The heater power source 712 that supplies electric power to the heater 711 may be connected to the temperature controller 714. The power supply from the heater power source 712 to the heater 711 may be controlled by the temperature controller 714.

The temperature sensor 713 may be fixed to the outer side surface of the cylindrical tank 261 in the vicinity of the nozzle 26. The temperature sensor 713 fixed to the tank 261 may be connected to the temperature controller 714. The temperature sensor 713 may detect the temperature of the tank 261 and output a detection signal to the temperature controller 714.

The temperature controller 714 may regulate the electric power supplied from the heater power source 712 to the heater 711, based on the detection signal outputted from the temperature sensor 713. The temperature controller 714 may control the heating condition of the tank 261 by regulating the electric power supplied to the heater 711. The temperature controller 714 may be connected to the target generation controller 74. Here, the hardware configuration of the temperature controller 714 will be described later with reference to FIG. 20.

With the above-described configuration, the temperature regulating mechanism 71 may regulate the temperature of the tank 261, based on the control signal from the target generation controller 74.

The pressure regulating mechanism 72 may regulate the pressure in the tank 261 by adjusting the pressure of the gas introduced into the tank 261. As shown in FIG. 3, the pressure regulating mechanism 72 may include a pressure regulator 721, pipes 722 to 724, a gas bomb 725, and an exhaust port 726.

The pipe 722 may connect between the bottom surface of the cylindrical tank 261 in the opposite side of the nozzle 262 and the pressure regulator 721. The pipe 723 may connect between the pressure regulator 721 and the gas bomb 725. The pipe 722 and the pipe 723 may extend to the interior of the pressure regulator 721 and be connected to the pipe 724 at a meeting point C. The pipe 724 may extend from the meeting point C in the pressure regulator 721 to the outside of the pressure regulator 721. The exhaust port 726 may be provided at the front end of the pipe 724 extending to the outside of the pressure regulator 721. The pipes 722 to 724 allow the target supplier 26 including the tank 261, the gas bomb 725, the exhaust port 726 and the pressure sensor 727 (described later) to communicate with each other. The pipes 722 to 724 may be covered with heat insulating materials (not shown). Heaters (not shown) may be provided in the pipes 722 to 724. The temperature in the pipes 722 to 724 may be maintained at the same temperature as the temperature in the tank 261 of the target supplier 26.

The gas bomb 725 may be filled with inert gas such as helium, argon and so forth. The gas bomb 725 may supply the inert gas into the tank 261 via the pressure regulator 721.

The exhaust port 726 may discharge the gas in the pipes 722 to 724 and the tank 261 via the pressure regulator 721. An exhaust pump (not shown) may be connected to the exhaust port 726. In this case, the exhaust pump may be connected to a pressure controller 728 (described later) which is included in the pressure regulator 721. The exhausting operation of the exhaust pump may be controlled based on an activating signal or a deactivating signal from the pressure controller 728.

The pressure regulator 721 may regulate the pressure in the tank 261 by adjusting the pressure of the inert gas supplied to the tank 261. The pressure regulator 721 may include a pressure sensor 727, the pressure controller 728, and valves V1 and V2, as well as part of the pipes 722 to 724 extending to the interior of the pressure regulator 721.

The pressure sensor 727 may detect the pressure in the tank 261 connected to the pressure sensor 727 via the pipe 722. The pressure sensor 727 may be provided in the pipe 722 between the meeting point C in the pressure regulator 721 and the tank 261. The pressure sensor 727 may be connected to the pressure controller 728. The pressure sensor 727 may output the detection signal of the detected pressure to the pressure controller 728.

The valve V1 may be provided in the pipe 723 between the meeting point C in the pressure regulator 721 and the gas bomb 725. The valve V2 may be provided in the pipe 724 between the meeting point C in the pressure regulator 721 and the exhaust port 726. The valves V1 and V2 may be solenoid valves. Each of the valves V1 and V2 may be connected to the pressure controller 728.

The pressure controller 728 may output a valve opening signal or a valve closing signal to each of the valve V1 and the valve V2 to control the opening and closing of the valves V1 and V2. The pressure controller 728 may be connected to the target generation controller 74. The pressure controller 728 may receive the control signal outputted from the target generation controller 74. The control signal outputted from the target generation controller 74 may be a signal for controlling the operation of the pressure regulator 721 to regulate the pressure in the tank 261 at a desired pressure value. The control signal may include a pressure setting value to be set in the pressure regulator 721 to regulate the pressure in the tank 261 at a desired pressure value. When the control signal is inputted to the pressure controller 728, the pressure setting value outputted from the target generation controller 74 may be set in the pressure controller 728. The pressure controller 728 may control the opening and closing of the valves V1 and V2 to make the value of the pressure detected by the pressure sensor 727 be the pressure setting value set by the target generation controller 74. The pressure controller 728 may supply/discharge the gas into/out of the tank 261 by controlling the opening and closing of the valves V1 and V2. The pressure controller 728 may increase or decrease the pressure in the tank 261 by supplying/discharging the gas into/out of the tank 261. Here, the hardware configuration of the pressure controller 728 will be described later with reference to FIG. 20.

With the above-described configuration, the pressure regulating mechanism 72 may regulate the pressure in the tank 261 by the pressure regulator 721 to make the value of the pressure in the tank 261 be the pressure setting value set by the target generation controller 74.

The droplet forming mechanism 73 may periodically divide the flow of the target 27 jetted from the nozzle 262 to form droplets 271. The droplet forming mechanism 73 may form the droplets 271 by, for example, the continuous jet method. With the continuous jet method, a standing wave may be given to the flow of the jetted target 27 by vibrating the nozzle 262 to periodically divide the target 27. The divided target 27 may form a free interface by means of its own surface tension to form a droplet 271. As shown in FIG. 3, the droplet forming mechanism 73 may include a piezoelectric element 731 and a piezoelectric power source 732.

The piezoelectric element 731 may be fixed to the outer side surface of the pipe-like nozzle 262. The piezoelectric element 731 fixed to the nozzle 262 may cause a vibration of the nozzle 262. The piezoelectric element 731 that causes a vibration of the nozzle 262 may be connected to the piezoelectric power source 732. The piezoelectric power source 732 may supply electric power to the piezoelectric element 731. The piezoelectric power source 732 that supplies electric power to the piezoelectric element 731 may be connected to the target generation controller 74.

With the above-described configuration, the droplet forming mechanism 73 may form the droplet 271, based on the control signal from the target generation controller 74.

The target generation controller 74 may send/receive the control signal to/from the EUV light generation controller 5 to totally control the entire operation of the target generation device 7. The target generation controller 74 may output the control signal to the temperature controller 714 to control the operation of the temperature regulating mechanism 71 including the temperature controller 714. The target generation controller 74 may output the control signal to the pressure controller 728 to control the operation of the pressure regulating mechanism 72 including the pressure controller 728. The target generation controller 74 may output the control signal to the piezoelectric power source 732 to control the operation of the droplet forming mechanism 73 including the piezoelectric power source 732. Here, the hardware configuration of the target generation controller 74 will be described later with reference to FIG. 20.

4.2 Operation

The operation of the target generation device 7 will be described with reference to FIG. 4. To be more specific, processes for target supply performed by the target generation controller 74 will be described with reference to FIGS. 2 to 4. Upon receiving a start signal to activate the target generation device 7, which is outputted from the EUV light generation controller 5, the target generation controller 74 may perform the following process.

In step S1, the target generation controller 74 may perform initial setting for the target generation device 7. The target generation controller 74 may activate each component of the target generation device 7 and perform operation check on each of the components. Then, the target generation controller 74 may initialize each of the components and set an initial setting value in each of the components.

Particularly, the target generation controller 74 may set the initial pressure setting value of the pressure regulator 721 to make the pressure in the tank 261 have a value of, for example, 1 hPa, which is close to the value for the vacuum state. The gas which is likely to react with the target 27 existing in the tank 261 may be discharged before the target 27 has molten. After that, inert gas may be supplied from the gas bomb 725 into the tank 261.

Moreover, the target generation controller 74 may cause the temperature controller 714 to set an initial temperature setting value of the heater 711 to make the temperature of the target 27 have a value equal to or higher than the melting point of the target 27. When the target 27 is tin, the initial temperature setting value of the heater 711 may be equal to or higher than 232 degrees Celsius and lower than 300 degrees Celsius. Alternatively, the initial temperature setting value of the heater 711 may be equal to or higher than 300 degrees Celsius. The target 27 accommodated in the tank 261 may be heated to a temperature equal to or higher than its melting point. The heated target 27 may be molten.

In step S2, the target generation controller 74 may determine whether or not a target generation signal has been inputted from the EUV light generation controller 5. The target generation signal may be a control signal to cause the target generation device 7 to supply the target 27 to the plasma generation region 25 in the chamber 2. The target generation controller 74 may wait until the target generation signal is inputted. The target generation controller 74 may continuously control the heating by the heater 711 to maintain the temperature of the target 27 within a predetermined range that is equal to or higher than the melting point of the target 27. When determining that the target generation signal has been inputted, the target generation controller 74 moves the step to step S3.

In the step S3, the target generation controller 74 may cause the temperature controller 714 to check the temperature of the tank 261. The target generation controller 74 may cause the temperature controller 714 to appropriately correct the temperature setting value to control the heating by the heater 711.

In step S4, the target generation controller 74 may perform a process for controlling target generation. The process for controlling target generation may be performed to control the operation of the target generation device 7 to make a parameter for the state of the droplet 271 outputted into the chamber 2 have a predetermined targeted value. To be more specific, the process for controlling target generation may include a process for forming the droplet 271, a process for calculating a parameter, and a process for controlling the pressure regulator 721. The process for controlling target generation can form the uniform droplets 271 at a constant frequency. The formed droplets 271 may be outputted into the chamber 2 and reach the plasma generation region 25 at a certain speed. Here, the process for controlling target generation will be described later with reference to FIG. 6.

The EUV light generation controller 5 may control the timing at which the pulsed laser beam 31 is outputted from the laser device 3 such that the pulsed laser beam 33 is emitted to the plasma generation region 25 in synchronization with that the droplet 271 reaches the plasma generation region 25. The pulsed laser beam 33 emitted to the plasma generation region 25 may be applied to the droplet 271 having reached the plasma generation region 25. The droplet 271 irradiated with the pulsed laser beam 33 may be turned into plasma and the EUV light 251 may be emitted from the plasma.

In step S5, the target generation controller 74 may determine whether or not a target generation stop signal has been inputted from the EUV light generation controller 5. The target generation stop signal may be a control signal for causing the target generation device 7 to stop supplying the target 27 to the plasma generation region 25. When determining that the target generation stop signal has not been inputted, the target generation controller 74 may move the step back to the step S3. On the other hand, when determining that the target generation stop signal has been inputted, the target generation controller 74 may end this process.

4.3 Problem

The EUV light generation apparatus 1 may output a plurality of droplets 271 into the chamber 2. It is preferred that the plurality of droplets 271 travel through the chamber 2 in a uniform state, and reach the plasma generation region 25. The period with which the droplet 271 is outputted from the target generation device 7 into the chamber 2 may be very short, for example, about 10 μs. The size of the droplet 271 may be very small, for example, about 20 μm. Therefore, there is a demand for a technology that can correctly measure whether or not the plurality of droplets 271 actually outputted into the chamber 2 travel through the chamber 2 in a uniform state.

The target generation device 7 may control the state of the droplets 271 outputted into the chamber 2 by regulating the pressure in the tank 261 by means of the pressure regulator 721. However, even if the pressure regulator 721 regulates the pressure in the tank 261 at a predetermined pressure, the state of the droplets 271 outputted into the chamber 2 may fluctuate in fact during the operation of the EUV light generation apparatus 1. For example, during the operation of the EUV light generation apparatus 1, impurities mixed into the target 27 may gradually accumulate in the filter 263. When an amount of the accumulation of the impurities is increased, the pressure loss of the target 27 passing through the filter 263 may be increased. When the pressure loss of the target 27 is increased, the speed and the flow rate of the droplet 271 outputted into the chamber 2 may be changed and decreased. Moreover, for example, the temperature of the gas in the tank 261 may be changed during the operation of the EUV light generation apparatus 1. When the pressure regulator 721 supplies inert gas into the tank 261, the temperature of the inert gas supplied into the tank 261 may be different from the temperature of the tank 261. While this difference in temperature is reduced over time, the pressure actually applied to the target 27 in the tank 261 may be changed. When the pressure applied to the target 27 is changed, for example, the speed and the flow rate of the droplets 271 outputted into the chamber 2 may be changed. As described above, even if the pressure in the tank 261 is regulated at a predetermined value, the state of the droplets 271 outputted into the chamber 2 may be changed in fact during the operation of the EUV light generation apparatus 1. Therefore, there is a demand for a technology that can correctly measure whether or not the plurality of droplets 271 actually outputted into the chamber 2 travel through the chamber 2 in a uniform state, and make the feedback of the result of the measurement to control the output of the droplets 271. Particularly, there is a demand for a technology that can make the feedback of the result of the measurement to control the pressure regulator 721 that regulates the pressure applied to the target 27 in the tank 261.

5. Target Generation System Included in the EUV Light Generation Apparatus According to Embodiment 1

5.1 Configuration

Figure 5:
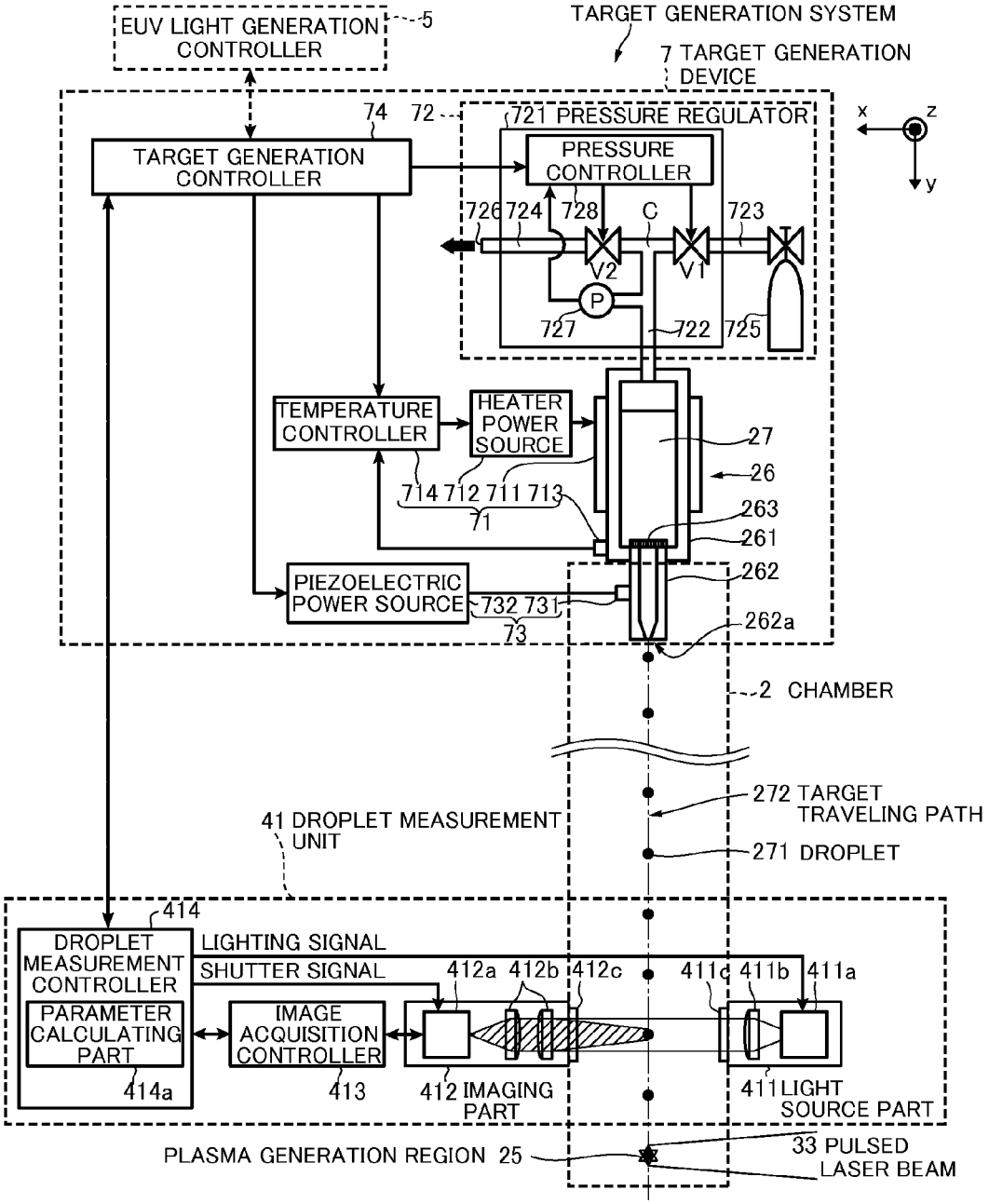
FIG. 5 shows the configuration of a target generation system included in the EUV light generation apparatus according to Embodiment 1.

The target generation system may include a target generation device and a droplet measurement unit that measures a parameter of the droplets outputted from the target generation device. The target generation system may control the output state of the target based on the measured parameter. With reference to FIG. 5, the configuration of the target generation system included in the EUV light generation apparatus 1 according to Embodiment 1 will be described. The target generation system included in the EUV light generation apparatus 1 according to Embodiment 1 may include the droplet measurement unit 41 and the target generation device 7.

The droplet measurement unit 41 may measure a parameter for the state of the droplets 271 outputted into the chamber 2. The droplet measurement unit 41 may be provided in the chamber 2. The droplet measurement unit 41 may be provided between the target supplier 26 and the plasma generation region 25 in the vicinity of the plasma generation region 25.

The droplet measurement unit 41 may include a light source part 411, an imaging part 412, an image acquisition controller 413, and a droplet measurement controller 414. The light source part 411 and the imaging part 412 may be placed to face to one another via a target traveling path 272 through which the target 27 outputted into the chamber 2 travels. The direction in which the light source part 411 and the imaging part 412 face to one another may be orthogonal to the target traveling path 272.

The light source part 411 may emit pulsed light to the droplets 271 traveling through the target traveling path 272. The light source part 411 may include a light source 411*a*, an illumination optical system 411*b*, and a window 411*c*.

The light source 411*a* may be, for example, a xenon flash tube and a laser beam source which perform pulse-lighting. The period of time between the start and the end of lighting the light source 411*a* included in the light source part 411 may be referred to as "lighting time $\Delta\tau$." The lighting time $\Delta\tau$ of the light source 411*a* may be sufficiently shorter than the period with which the droplets 271 are outputted from the target generation device 7 into the chamber 2. For example, the period with which the droplets 271 are outputted from the target supplier 26 into the chamber 2 may be about 10 μs, and the lighting time $\Delta\tau$ of the light source 411*a* may be from 10 ns to 100 ns. Here, the period with which the droplets 271 are outputted from the target supplier 26 into the chamber 2 may be referred to as "generation period" of the droplets 271. The light source 411*a* may be connected to the droplet measurement controller 414. The light source 411*a* may perform pulse-lighting based on a lighting signal outputted from the droplet measurement controller 414, and emit pulsed light.

The illumination optical system 411*b* may include a collimator, or be formed by an optical element such as lens. The illumination optical system 411*b* may guide the pulsed light emitted from the light source 411*a* onto the target traveling path 272 via the window 411*c*.

With the above-described configuration, the light source part 411 may emit the pulsed light to the target traveling path 272, based on the lighting signal outputted from the droplet measurement controller 414. The pulsed light emitted from the light source part 411 may be applied to the droplets 271 traveling through the target traveling path 272 placed between the light source part 411 and the imaging part 412.

The imaging part 412 may capture the images of the shadows of the droplets 271 irradiated with the pulsed light by the light source 411. The imaging part 412 may include an image sensor 412*a*, a transfer optical system 412*b* and a window 412*c*.

The transfer optical system 412*b* may be an optical element such as a pair of lenses. These lenses may be cylindrical lenses. The transfer optical system 412*b* may form the image of the shadow of the droplet 271 guided via the window 412*c*, on the light receiving surface of the image sensor 412*a*.

The image sensor 412*a* may be a two-dimensional image sensor such as a CCD (charge-coupled device) and a CMOS (complementary metal oxide semiconductor). The image sensor 412*a* may include a shutter (not shown). Then, the image sensor 412*a* may capture the image of the shadow of the droplet 271, which has been formed by the transfer optical system 412*b*. The period of time for which the image sensor 412*a* captures an image may be sufficiently longer than the lighting time $\Delta\tau$ of the light source 411*a*. The time interval at which the image sensor 412*a* performs an imaging operation may be, for example, from 0.1 s to 1 s. Here, the time interval at which the image sensor 412*a* of the imaging part 412 performs an imaging operation may be referred to as "measurement interval K" of the droplet measurement unit 41.

The image sensor 412*a* may be connected to the droplet measurement controller 414. The image sensor 412*a* may open and close the shutter according to a shutter signal from the droplet measurement controller 414, and capture the images of the shadows of the droplets 271. The image sensor 412*a* may capture the image only when the shutter (not shown) is open. The shutter may be an electric shutter or a mechanical shutter. Here, the period of time between the opening and closing of the shutter during which the image sensor 412*a* of the imaging part 412 performs an imaging operation once may be referred to as "imaging time $\Delta t$."

The image sensor 412*a* may be connected to the image acquisition controller 413. The image sensor 412*a* may output an image signal for the captured images of the shadows of the droplets 271, to the image acquisition controller 413 every time the image sensor 412*a* performs an imaging operation.

The image acquisition controller 413 may generate image data such as bitmap data on the images of the shadows of the droplets 271, based on the image signal outputted from the image sensor 412*a*. The image acquisition controller 413 may store the generated image data in association with the identification information of the image data. The identification information of the image data may be information regarding the time at which the image data is generated. The image acquisition controller 413 may be connected to the droplet measurement controller 414. The image acquisition controller 413 may output the generated image data and the identification information thereof, to the droplet measurement controller 414, according to the control signal from the droplet measurement controller 414. Here, the hardware configuration of the image acquisition controller 413 will be described later with reference to FIG. 20.

The droplet measurement controller 414 may output the lighting signal and the shutter signal to the light source part 411 and the imaging part 412, to control the operations of the light source part 411 and the imaging part 412, respectively. The droplet measurement controller 414 may include a timer T (not shown). The timer T may be a timer to measure timings at which the lighting signal and the shutter signal are outputted. The droplet measurement controller 414 may measure the elapse of each of the lighting time $\Delta\tau$, the imaging time $\Delta t$, and the measurement interval K.

The droplet measurement controller 414 may store the image data and the identification information thereof outputted from the image acquisition controller 413. The droplet measurement controller 414 may include a parameter calculating part 414*a*. The parameter calculating part 414*a* may be a program for calculating the parameters for the state of the droplets 271, based on the image data. The droplet measurement controller 414 may calculate the parameters based on the image data outputted from the image acquisition controller 413, by using the parameter calculating part 414*a*.

The parameters calculated by using the parameter calculating part 414*a* may be physical quantities representing the dynamic state of the droplets 271 outputted into the chamber 2. The parameters may include, for example, a diameter D, a volume V, a position Y, a traveling speed v, a generation frequency f, a flow rate Q, and a distance d of the droplet(s) 271 traveling through the chamber 2.

"Position Y" of the droplet 271 may be the position of the droplet 271 outputted from the target supplier 26 into the chamber 2 in the traveling direction of the droplet 271. The traveling direction of the droplet 271 may be, for example, y-direction of the coordinate system shown in FIG. 5. When the droplet measurement unit 41 is fixed to the chamber 2, the imaging part 412 of the droplet measurement unit 41 may measure a specified range on the target traveling path 272 by the fixed-point observation. The imaging range of the imaging part 412 may be located a certain distance away from the target supplier 26 on the target traveling path 272. The position Y of the droplet 271 may be a relative position within the imaging range in the traveling direction of the droplets 271. In the captured image data, the position Y of the droplet 271 may be placed in the direction parallel to the traveling direction of the droplets 271.

"Generation frequency f" of the droplets 271 may be the number of the droplets 271 outputted from the target supplier 26 into the chamber 2 per unit time. "Flow rate Q" of the droplets 271 may be the volume V of the droplets 271 outputted from the target supplier 26 into the chamber 2 per unit time. "Distance d" of the droplets 271 may be the distance between two adjacent droplets 271 sequentially outputted from the target supplier 26 into the chamber 2 in the traveling direction of the droplets 271.

The droplet measurement controller 414 may be connected to the target generation controller 74. The droplet measurement controller 414 may output the calculated parameter of the droplets 271 to the target generation controller 74. Here, the droplet measurement controller 414 may output the parameter to the target generation controller 74 without a command from the target generation controller 74. The droplet generation controller 414 may perform the processes for controlling the light source part 411 and the imaging part 412, acquiring the image data, and calculating the parameters, without commands from the target generation controller 74. The hardware configuration of the droplet measurement controller 414 will be described later with reference to FIG. 20.

With the above-described configuration, the droplet measurement unit 41 may capture the images of the shadows of the droplets 271 outputted from the target supplier 26 into the chamber 2, and acquire image data thereof. Then, the droplet measurement unit 41 may calculate the parameter of the droplets 271 based on the acquired image data, and output the parameter to the target generation controller 74. As described above, the droplet measurement unit 41 may measure the parameter for the state of the droplets 271 outputted into the chamber 2 and output the result of the measurement of the parameter to the target generation controller 74.

The target generation controller 74 included in the target generation device 7 shown in FIG. 5 may totally control the entire operation of the target generation device 7, based on the result of the measurement of the parameter outputted from the droplet measurement unit 41. Particularly, the target generation controller 74 may control the pressure regulator 721, based on the result of the measurement of the parameter. For example, the target generation controller 74 may determine the pressure setting value to be set in the pressure regulator 721, based on the difference between the value of the parameter measured by the droplet measurement unit 41 and the targeted value of the parameter. The target generation controller 74 may output a control signal containing the determined pressure setting value to the pressure regulator 721, and control the operation of the pressure regulator 721 to make the pressure in the tank 261 have a desired pressure value. The targeted value of each parameter may be a design value that is previously determined for the parameter, and be previously inputted to the target generation controller 74. The targeted value may be inputted to the target generation controller 74 by the operator or via the EUV light generation controller 5 or the network. The other configuration of the target generation controller 74 and the target generation device 7 may be the same as those in FIG. 3.

5.2 Operation

Figure 6:
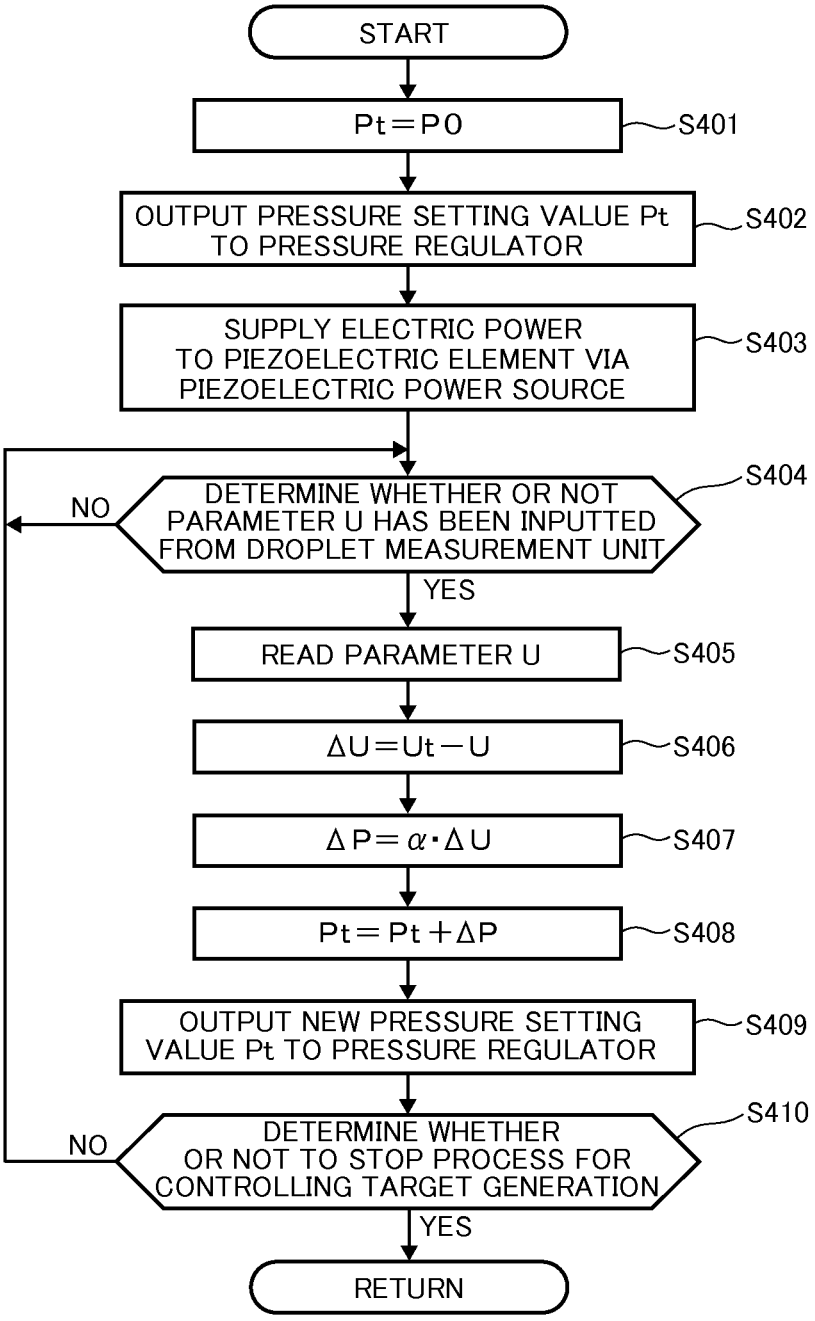
FIG. 6 is a flowchart showing a process for controlling target generation performed by the target generation controller shown in FIG. 5.

The operation of the target generation system included in the EUV light generation apparatus 1 according to Embodiment 1 will be described with reference to FIGS. 5 to 9. Upon receiving a target generation signal outputted from the EUV light generation controller 5, the target generation controller 74 may perform the process for target supply shown in FIG. 4. Then, the target generation controller 74 may perform the process for controlling the target generation in the step S4 shown in FIG. 4. With reference to FIG. 6, the process for controlling target generation performed by the target generation controller 74 will be described.

In step S401, the target generation controller 74 may set a pressure setting value Pt in the pressure regulator 721 to P0. P0 may be a pressure value corresponding to a targeted value Ut of the parameter. P0 may be, for example, from 10 MPa to 20 MPa. The targeted value Ut of the parameter may include, for example, a targeted diameter Dt, a targeted volume Vt, a targeted position Yt, a targeted traveling speed vt, a targeted generation frequency ft, a targeted flow rate Qt, and a targeted distance dt of the droplet(s) 271 traveling through the chamber 2.

In step S402, the target generation controller 74 may output the pressure setting value Pt set in the step S401 to the pressure regulator 721. The pressure regulator 721 may supply inert gas from the gas bomb 725 into the tank 261 according to the pressure setting value Pt. The pressure is applied to the molten target 27 in the tank 261, so that the molten target 27 is jetted from the nozzle hole 262*a*.

In step S403, the target generation controller 74 may cause the piezoelectric power source 732 to supply electric power to the piezoelectric element 731. The piezoelectric element 731 may cause a vibration of the nozzle 262. When the molten target 27 is jetted from the nozzle hole 262*a*, the vibration of the nozzle 262 may cause the molten target 27 to be divided, and therefore the droplets 271 may be formed. Here, the target generation controller 74 may cause the piezoelectric power source 732 to supply the electric power having a predetermined waveform to the piezoelectric element 731. This predetermined waveform may be a waveform to generate the droplets 271 at a predetermined generation frequency f. The predetermined generation frequency f may be, for example, from 50 kHz to 100 kHz.

In step S404, the target generation controller 74 may determine whether or not the result of the measurement of parameter U has been inputted from the droplet measurement unit 41. The parameter U may include, for example, the diameter D, the volume V, the position Y, the traveling speedy, the generation frequency f, the flow rate Q, and the distance d of the droplet (s) 271 traveling through the chamber 2. When determining that the result of the measurement of the parameter U has not been inputted from the droplet measurement unit 41, the target generation controller 74 may wait. On the other hand, when determining that the result of the measurement of the parameter U has been inputted from the droplet measurement unit 41, the target generation controller 74 may move the step to step S405.

In the step S405, the target generation controller 74 may read the result of the measurement of the parameter U inputted from the droplet measurement unit 41, and store the read result as a measured value U.

In step S406, the target generation controller 74 may calculate a difference ΔU between the measured value U stored in the step S405 and the targeted value Ut. The target generation controller 74 may calculate the difference ΔU according to the following equation.

$$\Delta U = Ut - U$$

In step S407, the target generation controller 74 may convert the difference ΔU calculated in the step S406 into an amount of correction of the pressure ΔP. The amount of correction of the pressure ΔP may be an amount of correction of the pressure setting value Pt to correct the difference ΔU between the measured value U of each parameter and the targeted value Ut with the change in the pressure in the tank 261. The target generation controller 74 may calculate the amount of correction of the pressure ΔP according to the following equation.

$$\Delta P = \alpha \cdot \Delta U$$

Here, α may be a coefficient to convert the difference ΔU of the parameter into the amount of correction of the pressure ΔP. The coefficient α may be a proportional constant when there is a proportionality between the difference ΔU of the parameter and the amount of correction of the pressure ΔP. The coefficient α may be a design value that is previously determined for each parameter, and be previously inputted to the target generation controller 74. The coefficient α may be inputted to the target generation controller 74 by the operator or via the EUV light generation controller 5 or the network.

In step S408, the target generation controller 74 may calculate a new pressure setting value Pt, based on the amount of correction of the pressure ΔP calculated in the step S407 and the current pressure setting value Pt. The target generation controller 74 may calculate the new pressure setting value Pt according to the following equation.

$$Pt = Pt + \Delta P$$

In step S409, the target generation controller 74 may output the new pressure setting value Pt calculated in the step S408 to the pressure regulator 721. The pressure regulator 721 may supply or discharge gas into or out of the tank 261 to make the pressure in the tank 261 have the new pressure setting value Pt. The pressure applied to the molten target 27 in the tank 261 is increased or decreased, so that the parameter U of the droplets 271 outputted into the chamber 2 may approach the targeted value Ut.

In step S410, the target generation controller 74 may determine whether or not to stop the process for controlling target generation. The target generation controller 74 may monitor whether or not the difference ΔU of the parameter is stable, that is, falls within a predetermined allowable range for a predetermined period of time, and, when the difference ΔU falls within the predetermined allowable range, the target generation controller 74 may stop the process for controlling target generation once. Moreover, for example, when an error occurs due to an unforeseen circumstance, the target generation controller 74 may stop the process for controlling target generation once. When determining not to stop the process for controlling target generation, the target generation controller 74 may move the step back to the step S404. On the other hand, when determining to stop the process for controlling target generation, the target generation controller 74 may end the process.

Figure 7:
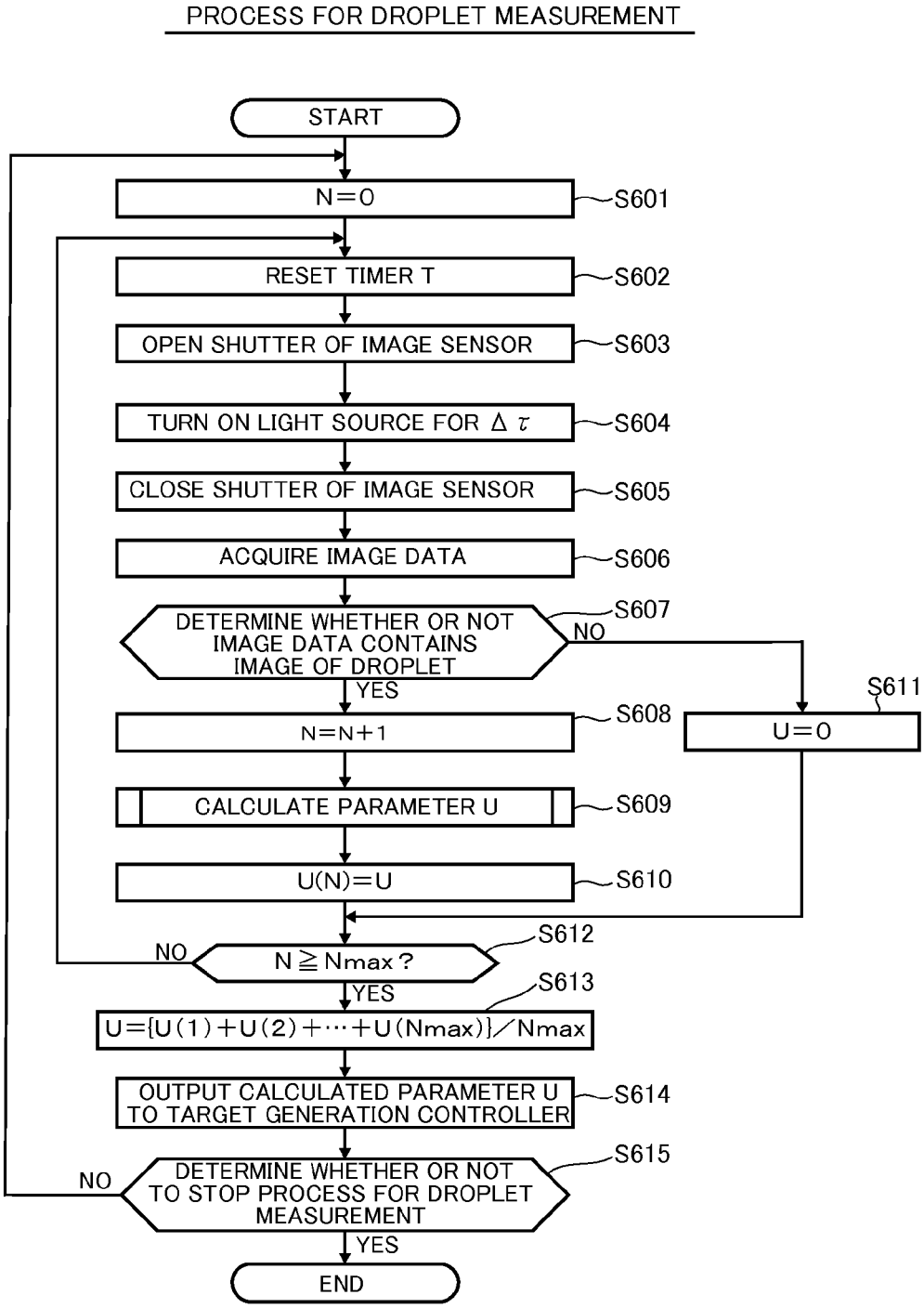
FIG. 7 is a flowchart showing a process for droplet measurement performed by a droplet measurement controller shown in FIG. 5.

With reference to FIG. 7, the process for droplet measurement performed by the droplet measurement controller 414 will be described. The process for droplet measurement may be a process for controlling the operation of the droplet measurement unit 41 in order to measure various parameters for the state of the droplets 271 outputted into the chamber 2. The droplet measurement controller 414 may perform the following process as the process for droplet measurement, without a command from the target generation controller 74. The process for controlling target generation performed by the target generation controller 74 shown in FIG. 6 and the process for droplet measurement performed by the droplet measurement controller 414 shown in FIG. 7 may be performed in parallel.

In step S601, the droplet measurement controller 414 may reset the number of measured droplets 271 (hereinafter "measured number N") as N=0.

In step S602, the droplet measurement controller 414 may reset the timer T and start measuring with the timer T.

In step S603, the droplet measurement controller 414 may output a shutter signal to open the shutter of the image sensor 412*a* of the imaging part 412, to the image sensor 412*a*. The droplet measurement controller 414 may store the value of the timer T when the shutter signal to open the shutter is outputted.

In step S604, the droplet measurement controller 414 may output a lighting signal to the light source 411*a* only for the predetermined lighting time Δτ in order to turn on the light source 411*a* of the light source part 411. The light source 411*a* may emit pulsed light to the target traveling path 272 until the lighting time Δτ has elapsed.

In step S605, after a predetermined imaging time Δt has elapsed, the droplet measurement controller 414 may output a shutter signal to close the shutter of the image sensor 412*a*, to the image sensor 412*a*. The imaging time Δt may be a period of time from when the shutter of the image sensor 412*a* is opened in the step S603 until the shutter is closed in the step S605. The image sensor 412*a* may capture the images of the shadows of the droplets 271, which are formed during the imaging time Δt. The droplet measurement controller 414 may store the value of the timer T when the shutter signal to close the shutter is outputted.

In step S606, the droplet measurement controller 414 may acquire the data on the images of the shadows of the droplets 271 captured in the step S605, from the image acquisition controller 413.

In step S607, the droplet measurement controller 414 may determine whether or not the image data acquired in the step S606 contains the droplet 271. When determining that the acquired image data contains the droplet 271, the droplet measurement controller 414 may move the step to step S608. On the other hand, when determining that the acquired image data does not contain any droplet 271, the droplet measurement controller 414 may move the step to step S611.

In the step S608, the droplet measurement controller 414 may update the measured number N of the droplets 271. The droplet measurement controller 414 may update the measured number N of the droplets 271 by the increment according to the following equation.

$$N=N+1$$

In step S609, the droplet measurement controller 414 may calculate the parameter U of the droplet 271 contained in the image data acquired in the step S606. Here, a process for calculating the parameter U of the droplet 271 will be described later with reference to FIGS. 8A and 9A.

In step S610, the droplet measurement controller 414 may store the parameter U calculated in the step S609 as U(N)=U. U(N) may be the value obtained by which the parameter U calculated in the step S609 is associated with the measured number N updated in the step S608. The droplet measurement controller 414 may store the values of the plurality of parameters U currently and previously calculated, in association with the values of the measured number N for each of the calculations of the values of the plurality of parameters U.

In the step S611, the droplet measurement controller 414 may set the parameter U to U=0. When the image data acquired in the step S606 does not contain any droplet 271, the droplet measurement controller 414 may regard the parameter U of the droplets 271 as U=0.

In step S612, the droplet measurement controller 414 may determine whether or not the measured number N updated in the step S608 is equal to or greater than Nmax. Nmax may be a threshold representing the measured number N which is required to calculate the average value of the parameter U. Nmax may be a value which is predefined by using a statistic technique, in consideration of the variation of the parameters U. Nmax may be, for example, from 100 to 1000. When determining that the measured number N is equal to or greater than Nmax, the droplet measurement controller 414 may move the step to step S613. On the other hand, when determining that the measured number N is not equal to or greater than Nmax, the droplet measurement controller 414 may move the step back to the step S602.

In the step S613, the droplet measurement controller 414 may calculate the average value of the parameter U. The droplet measurement controller 414 may calculate the average value of the parameters U according to the following equation.

$$U=\{U(1)+U(2)+\ldots+U(N\max)\}/N\max$$

In step S614, the droplet measurement controller 414 may output the average value of the parameter U calculated in the step S613, to the target generation controller 74. The droplet measurement controller 414 may output the average value of the plurality of parameters U calculated currently and previously, and therefore output the precise parameter U to the target generation controller 74.

In step S615, the droplet measurement controller 414 may determine whether or not to stop the process for droplet measurement. After the droplet measurement controller 414 has outputted the parameters U to the target generation controller 74, for example, a predetermined number of times, the droplet measurement controller 414 may stop the process for droplet measurement once. Moreover, when an error occurs due to an unforeseen circumstance, the droplet measurement controller 414 may stop the process for droplet measurement once. When determining not to stop the process for droplet measurement, the droplet measurement controller 414 may move the step back to the step S601. On the other hand, when determining to stop the process for droplet measurement, the droplet measurement controller 414 may end the process.

Figure 8A:
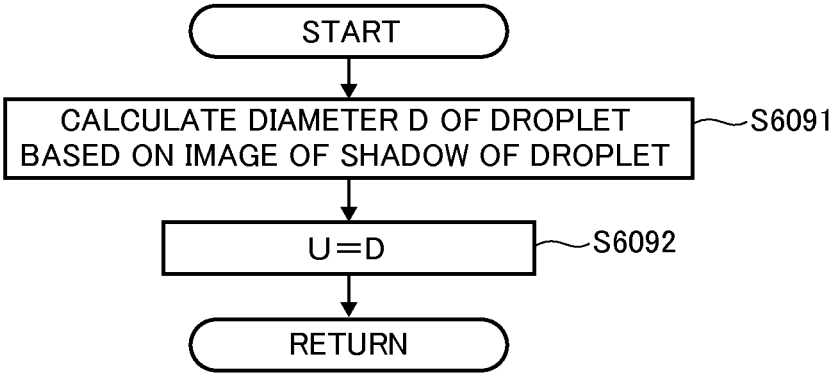
FIG. 8A is a flowchart showing a process for calculating the diameter of a droplet, as the process for calculating a parameter of a droplet shown in FIG. 7.
Figure 8B:
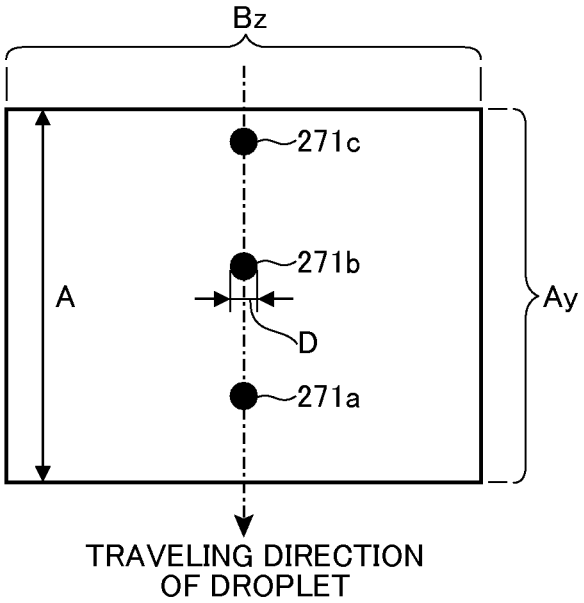
FIG. 8B schematically shows a picture of droplets captured by an imaging part shown in FIG. 5.

Now, a process for calculating the parameter U of the droplet 271 performed by the droplet measurement controller 414 will be described with reference to FIGS. 8 and 9. FIG. 8A shows an exemplary process for calculating the diameter D of the droplet 271, as an example of the process for calculating the parameter U in the step S609 shown in FIG. 7. FIG. 8B schematically shows a picture of the droplets 271 captured by the image sensor 412*a* of the imaging part 412. Droplets 271*a* to 271*c* shown in FIG. 8B may correspond to a plurality of droplets 271 sequentially outputted into the chamber 2.

In step S6091, the droplet measurement controller 414 may calculate the diameter D of the droplet 271, based on the image of the shadow of the droplet 271 contained in the image data acquired in the step S606 in FIG. 7.

In step S6062, the droplet measurement controller 414 may store the diameter D calculated in the step S6091 as the parameter U=D.

The image data of the droplets 271 captured by the image sensor 412*a* of the imaging part 412 may represent the picture as shown in FIG. 8B for a single imaging operation. The droplet measurement controller 414 may define, as the diameter D of the droplet 271, the width of the image of the droplet 271 contained in the image data in the direction perpendicular to the traveling direction of the droplet 271. When the shadow of one approximately spherical droplet 271 is captured as an image formed in an approximately spherical shape, the droplet measurement controller 414 may calculate the diameter D by the following method. That is, the droplet measurement controller 414 may define, as the diameter D of the droplet 271, the value obtained by averaging the width of the image of the droplet 271 in the traveling direction of the droplet 271 and the width of the image of the droplet 271 in the direction perpendicular to the traveling direction.

Here, the average value of the diameter D calculated by the process shown in FIG. 8A is obtained by the calculation as shown in FIG. 7. After that, the diameter D may be outputted from the droplet measurement unit 41 including the droplet measurement controller 414 to the target generation device 7 including the target generation controller 74. The target generation device 7 may read the outputted diameter D, and determine the pressure setting value to be set in the pressure regulator 721 based on the difference between the diameter D and the targeted diameter Dt, by the process shown in FIG. 6. The targeted diameter Dt may be, for example, from 10 μm to 30 μm. Then, the target generation device 7 may regulate the pressure in the tank 261 to be made to have the determined pressure setting value, and therefore regulate the pressure applied to the target 27.

Figure 9A:
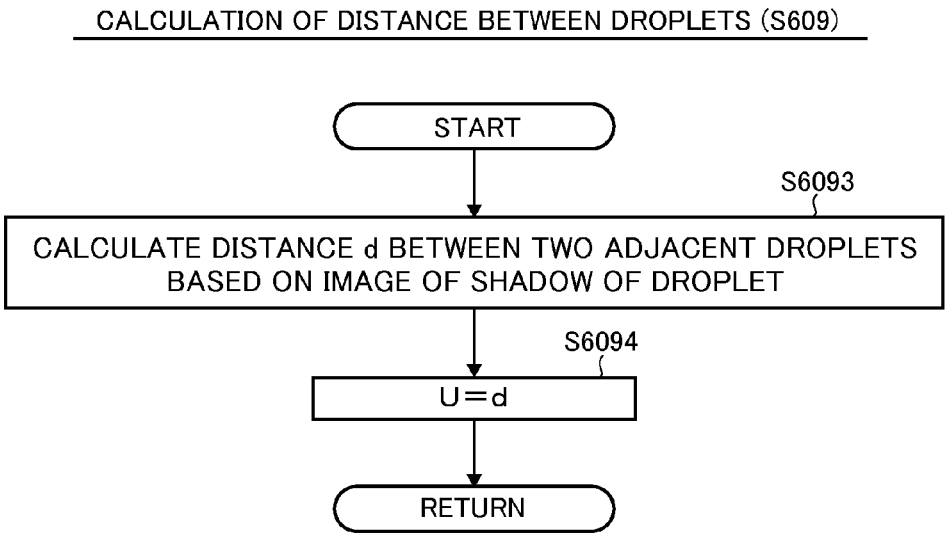
FIG. 9A is a flowchart showing a process for calculating the distance between droplets, as the process for calculating a parameter of a droplet shown in FIG. 7.
Figure 9B:
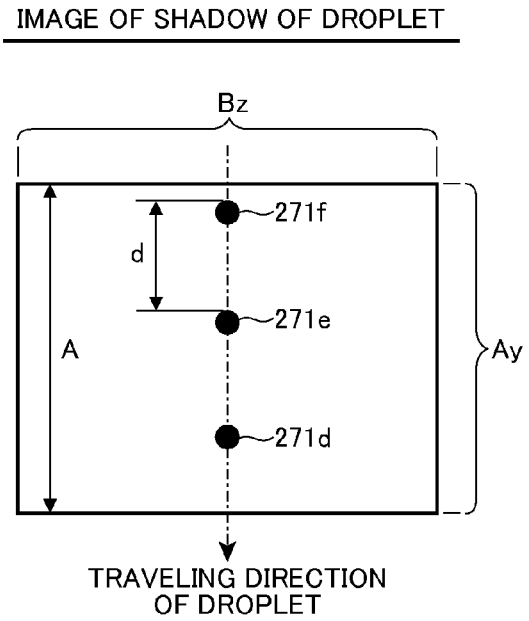
FIG. 9B schematically shows a picture of droplets captured by the imaging part shown in FIG. 5.

FIG. 9A shows an exemplary process for calculating the distance d between the droplets 271, as an example of the process for calculating the parameter U in the step S609 shown in FIG. 7. FIG. 9B schematically shows a picture of the droplets 271 captured by the image sensor 412*a* of the imaging part 412. Droplets 271*d* to 271*f* shown in FIG. 9B may correspond to a plurality of droplets 271 sequentially outputted into the chamber 2. Here, the process shown in FIG. 9A may be performed together with the process shown in FIG. 8A.

In step S6093, the droplet measurement controller 414 may calculate the distance d between two adjacent droplets 271, based on the images of the shadows of the droplets 271 contained in the image data acquired in the step S606 in FIG. 7.

In step S6094, the droplet measurement controller 414 may store the distance d calculated in the step S6093 as the parameter U=d.

As shown in FIG. 9B, the plurality of droplets 271 may be contained in the image data acquired by a single imaging operation, depending on the setting of the imaging time Δt of the image sensor 412*a*. When the distance d is calculated as the parameter U, in order to contain a plurality of droplets 271 in the image data acquired by a single imaging operation, the imaging time Δt of the image sensor 412*a* may be set as follows.

The length of the imaging range Ay×Bz of the image sensor 412*a* in the traveling direction of the droplets 271 is represented as A. The traveling speed of the droplet 271 is represented as v. In this case, the imaging time Δt may be set to satisfy the following expression.

$$(d-A)/v<\Delta t<d/v$$

Here, "d/v" in the right-hand side may represent the period of time for which the images of two adjacent droplets sequentially outputted into the chamber 2 do not completely overlap. Meanwhile, "(d−A)/v" in the left-hand side may represent the period of time for which the images of two adjacent droplets 271 sequentially outputted into the chamber 2 can be contained in the imaging range. By this means, the image sensor 412*a* of the imaging part 412 may capture the images of two adjacent droplets 271 sequentially outputted into the chamber 2 such that the images are contained in the imaging range without overlapping one other, every time the image sensor 412*a* performs an imaging operation. Therefore, the droplet measurement controller 414 may calculate the distance d every time the image sensor 412*a* performs an imaging operation. Here, when d≤A, the imaging time Δt may be set to 0<Δt<d/v.

In addition, the traveling speed v of the droplet 271 may be set to a predetermined value. Moreover, the traveling speed v of the droplet 271 may be calculated by the following method. Particularly, as shown in FIG. 9B, when the shadow of each of the droplets 271 is captured as one image in the image data acquired by a single imaging operation, the traveling speed v may be calculated by the following method.

The droplet measurement controller 414 may make a comparison between two pieces of image data obtained by imaging one droplet 271 at different timings. The droplet measurement controller 414 may calculate the difference in the position of the image of the one droplet 271 between the two pieces of image data, as the distance for which the droplet 271 travels during the measurement interval K. Alternatively, the droplet measurement controller 414 may emit pulsed light to one droplet 271 twice at the measurement interval K during a single imaging operation, and therefore acquire a multi-exposure image by using a piece of image data. The droplet measurement controller 414 may calculate the change in the position of the image of the one droplet 271, as the distance for which the droplet 271 travels during the measurement interval K. Then, the droplet measurement controller 414 may calculate the traveling speed v of the droplet 271 by dividing the calculated traveling distance of the droplet 271 by the measurement interval K.

Here, the average value of the distance d calculated by the process shown in FIG. 9A is obtained by the calculation as shown in FIG. 7. After that, the distance d may be outputted from the droplet measurement unit 41 including the droplet measurement controller 414 to the target generation device 7 including the target generation controller 74. The target generation device 7 may read the outputted interval d by the process shown in FIG. 6, and determine the pressure setting value to be set in the pressure regulator 721, based on the difference between the distance d and the targeted distance dt. The targeted distance dt may be, for example, 500 μm to 1000 μm. Then, the target generation device 7 may regulate the pressure in the tank 261, by the pressure regulator 721, to be made to have the determined pressure setting value, and therefore regulate the pressure applied to the target 27.

5.3 Effect

The EUV light generation apparatus 1 according to Embodiment 1 may correctly measure whether or not, for example, the diameter D of the droplets 271 and the distance d between the droplets 271 actually outputted into the chamber 2 are maintained in a uniform state. Then, the EUV light generation apparatus 1 may make the feedback of the measured diameter D and distance d to regulate the pressure to be applied to the target 27 in the tank 261. By this means, the EUV light generation apparatus 1 according to Embodiment 1 may stabilize the diameter D and the distance d of the droplets 271 actually outputted into the chamber 2 at respective targeted values in real time during the operation of the EUV light generation apparatus 1.

By stabilizing the diameter D as described above, the EUV light generation apparatus 1 may supply the droplets 271 which are the same in size, to the plasma generation region 25 in the chamber 2. Therefore, the EUV light generation apparatus 1 may stably generate the EUV light 252. By stabilizing the distance d as described above, the EUV light generation apparatus 1 may supply the droplets 271 to the plasma generation region 25 in the chamber 2 at a constant generation frequency f. Therefore, it is possible to easily synchronize the timing of the supply of the droplet 271 with the timing of the emission of the pulsed laser beam 33. As a result, the EUV light generation apparatus 1 may stably generate the EUV light 252.

6. Target Generation System Included in the EUV Light Generation Apparatus According to Embodiment 2

6.1 Configuration

The configuration of the target generation system included in the EUV light generation apparatus 1 according to Embodiment 2 is the same as that of Embodiment 1, and therefore duplicate descriptions will be omitted.

With Embodiment 1, for example, the processes for calculating the diameter D and the distance d of the droplets 271 may be performed, as the process for calculating the parameter U. Now, with Embodiment 2, as the process for calculating the parameter U, a process for calculating, for example, the position Y of the droplet 271 may be performed.

6.2 Operation

Figure 10:
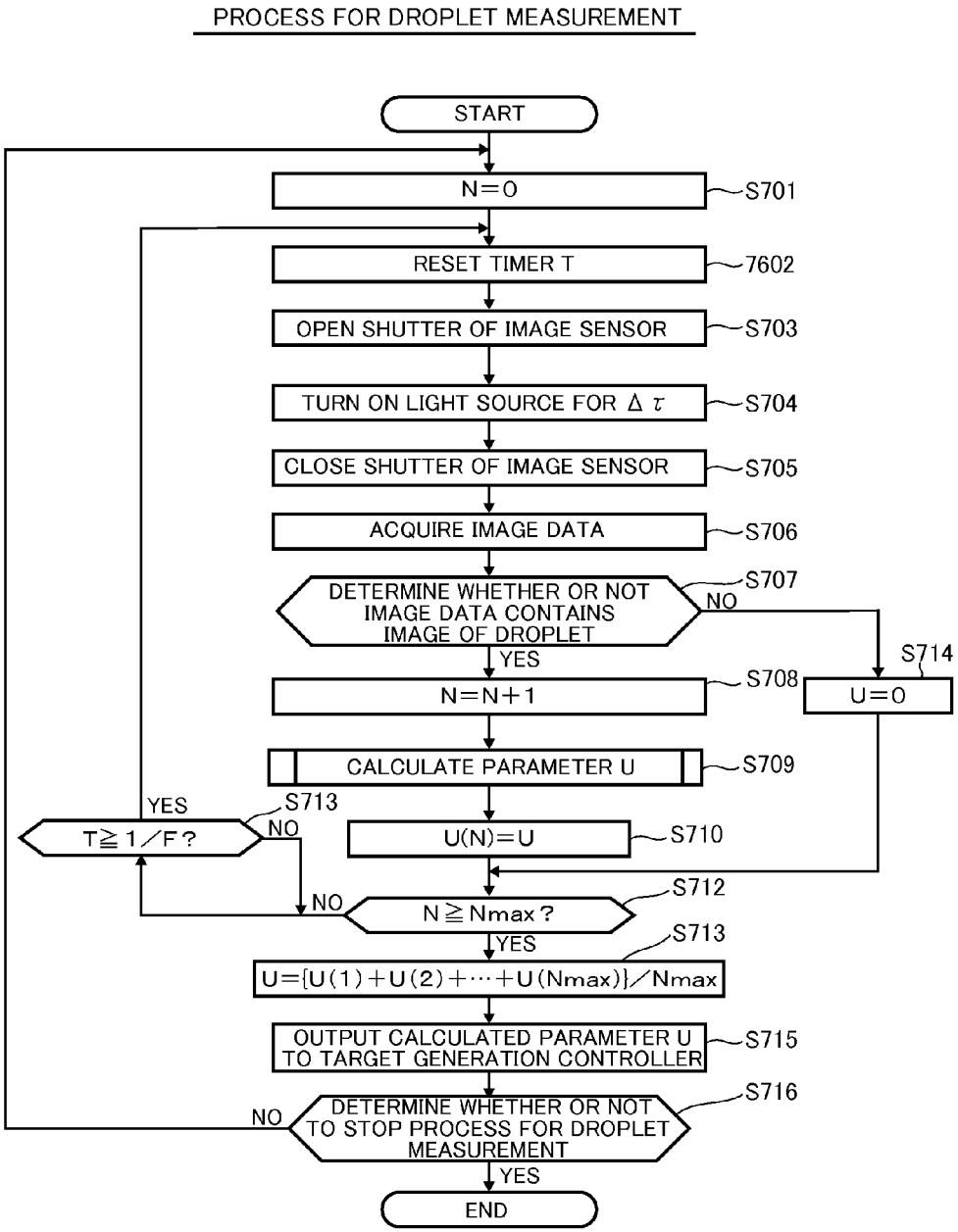
FIG. 10 is a flowchart showing a process for droplet measurement performed by the droplet measurement controller of the target generation system included in the EUV light generation apparatus according to Embodiment 2.

With reference to FIGS. 10 and 11, the operation of the target generation system included in the EUV light generation apparatus 1 according to Embodiment 2 will be described. The operation of the target generation system included in the EUV light generation apparatus 1 according to Embodiment 2 is different from that of Embodiment 1 shown in FIGS. 7 to 9 in the process for droplet measurement and the process for calculating the parameters U as shown in FIGS. 10 and 11. The other operation is the same as that of Embodiment 1, and therefore duplicate descriptions will be omitted.

The process for droplet measurement performed by the droplet measurement controller 414 will be described with reference to FIG. 10. The droplet measurement controller 414 may perform the following process as the process for droplet measurement, without a command from the target generation controller 74. The process for controlling target generation performed by the target generation controller 74 shown in FIG. 6 and the process for droplet measurement performed by the droplet measurement controller 414 shown in FIG. 10 may be performed in parallel.

Step S701 to step S708 performed by the droplet measurement controller 414 may be the same as the steps S601 to S608 shown in FIG. 7.

In step S709, the droplet measurement controller 414 may calculate the parameters U of the droplets 271 contained in the image data acquired in the step S706. With Embodiment 2, an exemplary process for calculating the position Y of the droplet 271 will be described, as an example of the process for calculating the parameter U. Here, the process for calculating the parameter U of the droplets 271 will be described later with reference to FIG. 11A.

In step S710, the droplet measurement controller 414 may store the parameter U calculated in the step S709 as U(N)=U. Here, the step S710 may be the same as the step S610 shown in FIG. 7.

In step S711, the droplet measurement controller 414 may set the parameter U as U=0. When the image data acquired in the step S706 does not contain any droplet 271, the droplet measurement controller 414 may regard the parameter U of the droplet 271 as U=0.

In step S712, the droplet measurement controller 414 may determine whether or not the measured number N updated in the step S708 is equal to or greater than Nmax. The step S712 may be the same as the step S612 shown in FIG. 7. When determining that the measured number N is equal to or greater than Nmax, the droplet measurement controller 414 may move the step to step S714. On the other hand, when determining that the measured number N is not equal to or greater than Nmax, the droplet measurement controller 414 may move the step to step S713.

In the step S713, the droplet measurement controller 414 may determine whether or not the value of the timer T having started in the step S702 is equal to or greater than 1/F. Here, "F" may be a divisor of the generation frequency f of the droplets 271. "1/F" may be equivalent to a multiple of the generation period of the droplets 271. When determining that the value of the timer T is not equal to or greater than 1/F, the droplet measurement controller 414 may wait. On the other hand, when determining that the value of the timer T is equal to or greater than 1/F, the droplet measurement controller 414 may move the step back to the step S702.

The droplet measurement controller 414 may wait until the value of the timer T having started in the step S702 reaches 1/F equivalent to a multiple of the generation period of the droplets 271. In addition, when the value of the timer T reaches 1/F equivalent to a multiple of the generation period of the droplets 271, the droplet measurement controller 414 may perform the step S703 to step S705 for the next imaging operation. By this means, the generation period and the measurement interval K of the droplets 271 may be synchronized. For example, if the generation frequency f of the droplets 271 is 100 kHz, and F is 20 Hz, the droplet measurement controller 414 may perform an imaging operation every measurement interval K=20 Hz, in synchronization with the generation period of the droplets 271.

In step S714, the droplet measurement controller 414 may calculate the average value of the parameter U. The step S714 may be the same as the step S613 shown in FIG. 7.

In step S715, the droplet measurement controller 414 may output the average value of the parameter U calculated in the step S714, to the target generation controller 74. The step S715 may be the same as the step S614 shown in FIG. 7.

In step S716, the droplet measurement controller 414 may determine whether or not to stop the process for droplet measurement. The step S716 may be the same as the step S615 shown in FIG. 7.

Figure 11A:
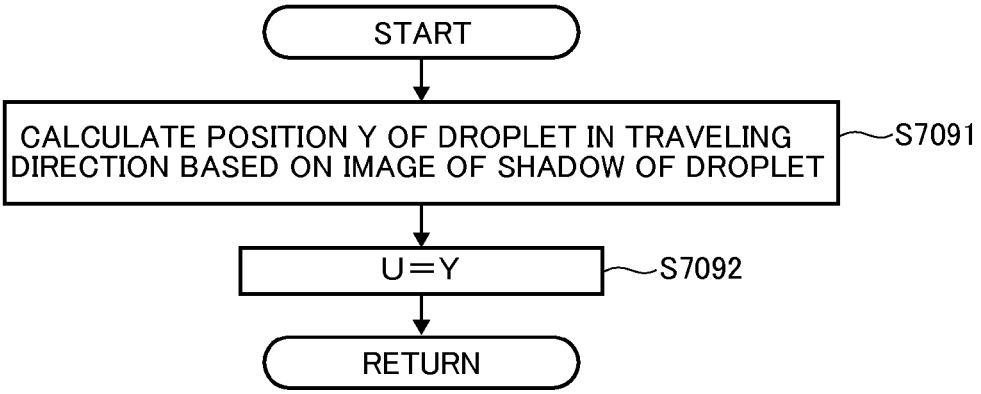
FIG. 11A is a flowchart showing a process for calculating the position of a droplet, as the process for calculating a parameter of a droplet shown in FIG. 10.
Figure 11B:
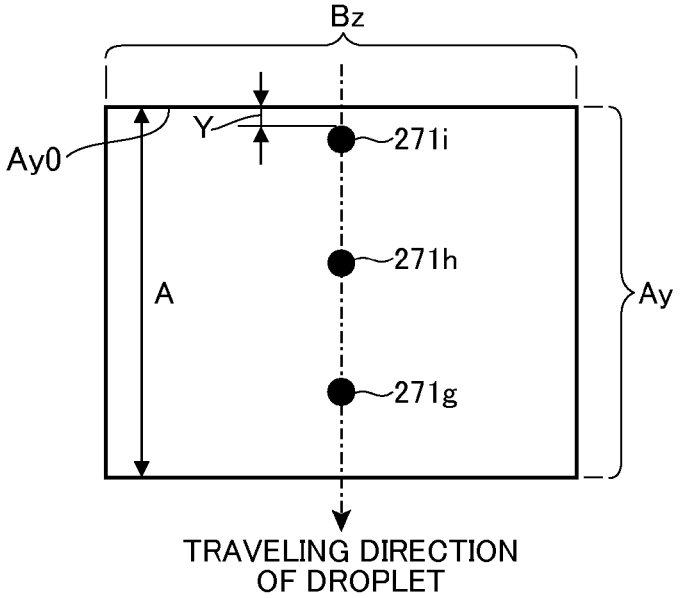
FIG. 11B schematically shows a picture of droplets captured by the imaging part of the target generation system included in the EUV light generation apparatus according to Embodiment 2.

With reference to FIG. 11, the process for calculating the parameters U of the droplets 271 performed by the droplet measurement controller 414 according to Embodiment 2 will be described. FIG. 11A shows an exemplary process for calculating the position Y of the droplet 271, as an example of the process for calculating the parameter U in the step S709 shown in FIG. 10. FIG. 11B schematically shows a picture of the droplets 271 captured by the image sensor 412*a* of the imaging part 412. Droplets 271*g* to 271*i* shown in FIG. 11B may represent a plurality of droplets 271 sequentially outputted into the chamber 2.

In step S7091, the droplet measurement controller 414 may calculate the position Y of the droplet 271, based on the images of the shadows of the droplets 271 contained in the image data acquired in the step S706 shown in FIG. 10.

In step S7092, the droplet measurement controller 414 may store the position Y calculated in the step S7091 as the parameter U=Y.

The position Y of the droplet 271 may be a relative position in the imaging range Ay×Bz in the traveling direction of the droplet 271. The droplet measurement controller 414 may define, as the reference line, the straight line that passes through the intersection between the traveling direction of the droplet 271 and the boundary line of the imaging range Ay×Bz and that is orthogonal to the traveling direction of the droplet 271. Then, the droplet measurement controller 414 may obtain the position Y by calculating the distance from the reference line to the droplet 271. For example, in FIG. 11B, the reference line may correspond to Ay0.

The imaging time Δt according to Embodiment 2 may satisfy the following expression like Embodiment 1.

$$(d-A)/v<\Delta t<d/v$$

Therefore, also with Embodiment 2, the image sensor 412*a* of the imaging part 412 may capture the images of the shadows of two adjacent droplets 271 sequentially outputted into the chamber 2 without overlapping one other, every time the image sensor 412*a* performs an imaging operation. As a result, the droplet measurement controller 414 may calculate the position Y every time the image sensor 412*a* performs an imaging operation.

Here, the average value of the position Y calculated by the process shown in FIG. 11A is obtained by the calculation as shown in FIG. 10. After that, the position Y may be outputted from the droplet measurement unit 41 including the droplet measurement controller 414 to the target generation device 7 including the target generation controller 74. The target generation device 7 may read the outputted position Y by the process shown in FIG. 6, and determine the pressure setting value to be set in the pressure regulator 721, based on the difference between the position Y and the targeted position Yt. Then, the target generation device 7 may regulate the pressure in the tank 261 at the determined pressure setting value by the pressure regulator 721, and therefore regulate the pressure applied to the target 27.

6.3 Effect

The EUV light generation apparatus 1 according to Embodiment 2 can correctly measure whether or not the trajectory of the droplets 271 actually outputted into the chamber 2 is maintained in a uniform state. Then, the EUV light generation apparatus 1 may make the feedback of the measured position Y to regulate the pressure to be applied to the target 27 in the tank 261. By this means, the EUV light generation apparatus 1 according to Embodiment 2 may stabilize the position Y of the droplet 271 actually outputted into the chamber 2 at the targeted value in real time during the operation of the EUV light generation apparatus 1.

By stabilizing the position Y as described above, the EUV light generation apparatus 1 may supply the droplets 271 to the plasma generation region 25 in the chamber 2 at a predetermined position. By this means, the EUV light generation apparatus 1 can easily synchronize the timing of the supply of the droplet 271 with the timing of the measurement of the droplet 271. As a result, the EUV light generation apparatus 1 can be consistently in control of the state of the droplet 271 in the chamber 2.

7. Target Generation System Included in the EUV Light Generation Apparatus According to Embodiment 3.

7.1 Configuration

The configuration of the target generation system included in the EUV light generation apparatus 1 according to Embodiment 3 is the same as that of Embodiment 1, and therefore duplicate descriptions will be omitted.

With Embodiment 1, as examples for the process for calculating the parameter U, the processes for calculating the diameter D and the distance d of the droplets 271 may be performed. With Embodiment 2, as an example of the process for calculating the parameter U, the process for calculating the position Y of the droplet 271 may be performed as an example. Now, with Embodiment 3, as the process for calculating the parameter U, a process for calculating, for example, the traveling speed v and the flow rate Q of the droplets 271 may be performed.

With Embodiments 1 and 2, the lighting time $\Delta\tau$ of the light source 411*a* of the droplet measurement unit 41 may be sufficiently shorter than the generation period of the droplets 271. For example, the generation period of the droplets 271 may be about 10 μs, and the lighting time $\Delta\tau$ may be from 10 ns to 100 ns. With Embodiment 3, the lighting time $\Delta\tau$ of the light source 411*a* of the droplet measurement unit 41 may be approximately equal to or shorter than the generation period of the droplets 271. For example, the generation period of the droplets 271 may be about 10 μs, and the lighting time $\Delta\tau$ may be from 1 μs to 5 μs. However, those values are merely examples, and preferably selected for an apparatus to which the embodiments are applied.

7.2 Operation

Figure 12:
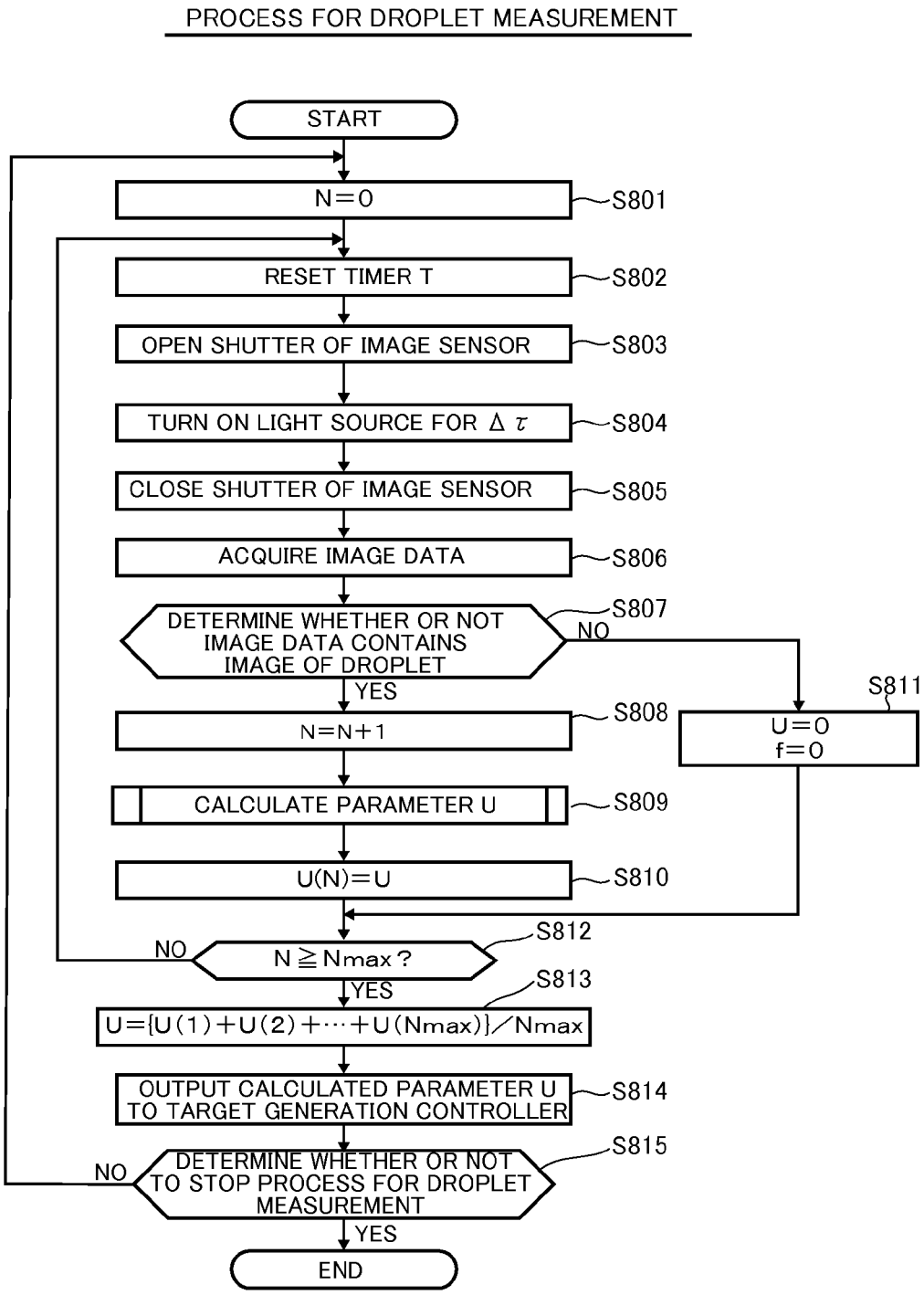
FIG. 12 is a flowchart showing a process for droplet measurement performed by the droplet measurement controller of the target generation system included in the EUV light generation apparatus according to Embodiment 3.

Now, with reference to FIGS. 12 to 14, the operation of the target generation system included in the EUV light generation apparatus 1 according to Embodiment 3 will be described. The operation of the target generation system included in the EUV light generation apparatus 1 according to Embodiment 3 is different from that of Embodiment 1 shown in FIGS. 7 to 9 in the process for droplet measurement and the process for calculating the parameter U as shown in FIGS. 12 to 14. The other operation is the same as that of Embodiment 1, and therefore duplicate descriptions will be omitted.

With reference to FIG. 12, the process for droplet measurement performed by the droplet measurement controller 414 will be described. The droplet measurement controller 414 may perform the following process as the process for droplet measurement, without a command from the target generation controller 74. The process for controlling target generation performed by the target generation controller 74 shown in FIG. 6 and the process for droplet measurement performed by the droplet measurement controller 414 shown in FIG. 12 may be performed in parallel.

Step S801 to step S808 performed by the droplet measurement controller 414 may be the same as the steps S601 to S608 shown in FIG. 7.

In step S809, the droplet measurement controller 414 may calculate the parameters U of the droplets 271 contained in the image data acquired in the step S806. With Embodiment 3, an exemplary process for calculating the traveling speed v and the flow rate Q of the droplets 271 will be described, as the process for calculating the parameter U. Here, the process for calculating the parameters U of the droplets 271 will be described later with reference to FIGS. 13A and 14A.

In step S810, the droplet measurement controller 414 may store the parameter U calculated in the step S809 as U(N)=U. Here, the step S810 may be the same as the step S610 shown in FIG. 7.

In step S811, the droplet measurement controller 414 may set the parameter U as U=0, and also set the generation frequency f of the droplets 271 as f=0. When the image data acquired in the step S806 does not contain any droplet 271, the droplet measurement controller 414 may regard the parameter U of the droplets 271 as U=0, and also regard the generation frequency f of the droplets 271 as f=0.

Step S812 to step S815 performed by the droplet measurement controller 414 may be the same as the steps S612 to S615 shown in FIG. 7.

Figure 13A:
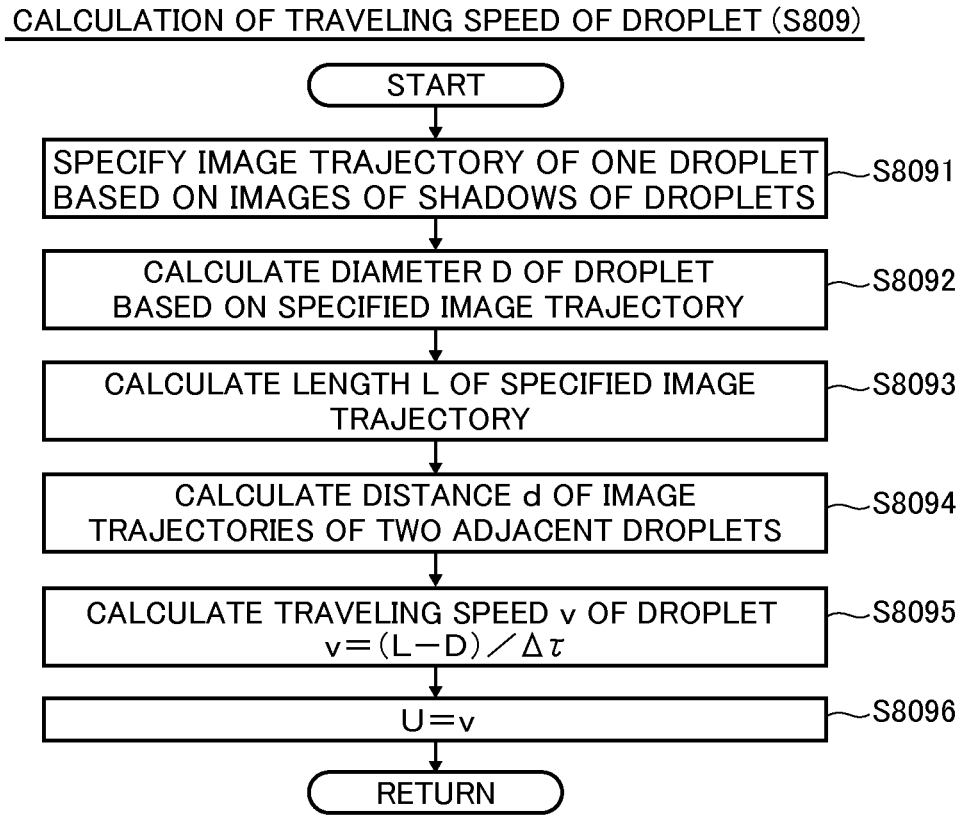
FIG. 13A is a flowchart showing a process for calculating the traveling speed of a droplet, as the process for calculating a parameter of a droplet shown in FIG. 12.
Figure 13B:
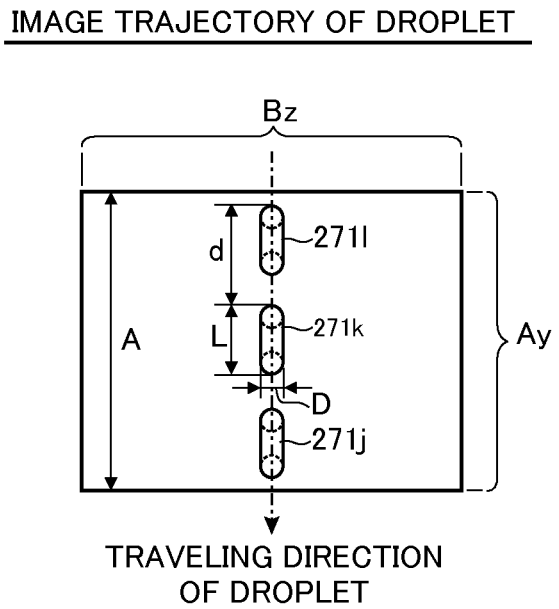
FIG. 13B schematically shows a picture of droplets captured by the imaging part of the target generation system included in the EUV light generation apparatus according to Embodiment 3.

With reference to FIG. 13, the process for calculating the parameters U of the droplets 271 performed by the droplet measurement controller 414 according to Embodiment 3 will be described. FIG. 13A shows an exemplary process for calculating the traveling speed v of the droplets 271, as the process for calculating the parameter U in the step S809 shown in FIG. 12. FIG. 13B schematically shows a picture of the droplets 271 captured by the image sensor 412*a* of the imaging part 412. Droplets 271*j* to 271*l* shown in FIG. 13B may represent a plurality of droplets 271 sequentially outputted into the chamber 2.

With Embodiment 3, the lighting time $\Delta\tau$ may be approximately equal to or shorter than the generation period of the droplets 271. Therefore, with Embodiment 3, the image of the shadow of one droplet 271 captured by a single imaging operation may be shown in the image data as an elongated image in the traveling direction, as shown in FIG. 13B. The elongated image of the shadow of one droplet 271 in the traveling direction may be referred to as "image trajectory" of the one droplet 271. In this case, the droplet measurement controller 414 may calculate the traveling speed v of the droplet 271 by performing the following process.

In step S8091, the droplet measurement controller 414 may specify the image trajectory of one droplet 271, based on the images of the shadows of the plurality of droplets 271 contained in the image data acquired in the step S806 shown in FIG. 12. For example, in FIG. 13B, the image trajectory of one droplet 271 may correspond to the image trajectory of the droplet 271*k*.

In step S8092, the droplet measurement controller 414 may calculate the diameter D of the droplet 271 based on the image trajectory specified in the step S8091. The droplet measurement controller 414 may define the width of the image trajectory in the direction perpendicular to the traveling direction of the droplet 271 as the diameter D of the droplet 271.

In step S8093, the droplet measurement controller 414 may calculate the length L of the image trajectory specified in the step S8091. "Length L of the image trajectory" may be the length of the image trajectory in the traveling direction of the droplet 271.

In step S8094, the droplet measurement controller 414 may calculate the distance d between the image trajectories of two adjacent droplets 271 sequentially outputted into the chamber 2. For example, in FIG. 13B, the image trajectories of "two adjacent droplets 271 that are sequentially outputted" may be the image trajectory 271*k* specified in the step S8091 and the image trajectory 271*l* closest to the image trajectory 271*k*. "Distance d between the image trajectories" may be the distance between the image trajectories of two droplets 271 in the traveling direction of the droplets 271. For example, in FIG. 13B, the distance d may be the distance between the image trajectory 271*k* and the image trajectory 271*l* in the traveling direction of the droplets 271.

In step S8095, the droplet measurement controller 414 may calculate the traveling speed v of the droplet 271, based on the diameter D calculated in the step S8092 and the length L calculated in the step S8093. The droplet measurement controller 414 may calculate the traveling speed v of the droplet 271 according to the following equation.

$$v=(L-D)/\Delta\tau$$

Here, "(L−D)" in the right-hand side may mean the distance for which one droplet 271 travels during the lighting time $\Delta\tau$.

In step S8096, the droplet measurement controller 414 may store the traveling speed v of the droplet 271 calculated in the step S8095 as the parameter U=v.

Here, the imaging time $\Delta t$ according to Embodiment 3 may satisfy the following expression like Embodiment 1.

$$(d-A)/v<\Delta t<d/v$$

Therefore, also with Embodiment 3, the image sensor 412*a* of the imaging part 412 may capture the image trajectories of two adjacent droplets 271 sequentially outputted into the chamber 2, without overlapping one another, every time the image sensor 412*a* performs an imaging operation. As a result, the droplet measurement controller 414 may calculate the traveling speed v and the flow rate Q, every time the image sensor 412*a* performs an imaging operation.

Here, the average value of the traveling speed v calculated by the process shown in FIG. 13A is obtained by the calculation as shown in FIG. 12. After that, the traveling speed v may be outputted from the droplet measurement unit 41 including the droplet measurement controller 414 to the target generation device 7 including the target generation controller 74 as shown in FIG. 12. The target generation device 7 may read the outputted traveling speed v, and determine the pressure setting value to be set in the pressure regulator 721, based on the difference between the traveling speed v and the targeted traveling speed vt, by the process shown in FIG. 6. The targeted traveling speed vt may be, for example, from 50 m/s to 100 m/s. Then, the target generation device 7 may regulate the pressure in the tank 261 at the determined pressure setting value, and therefore regulate the pressure applied to the target 27.

Figure 14A:
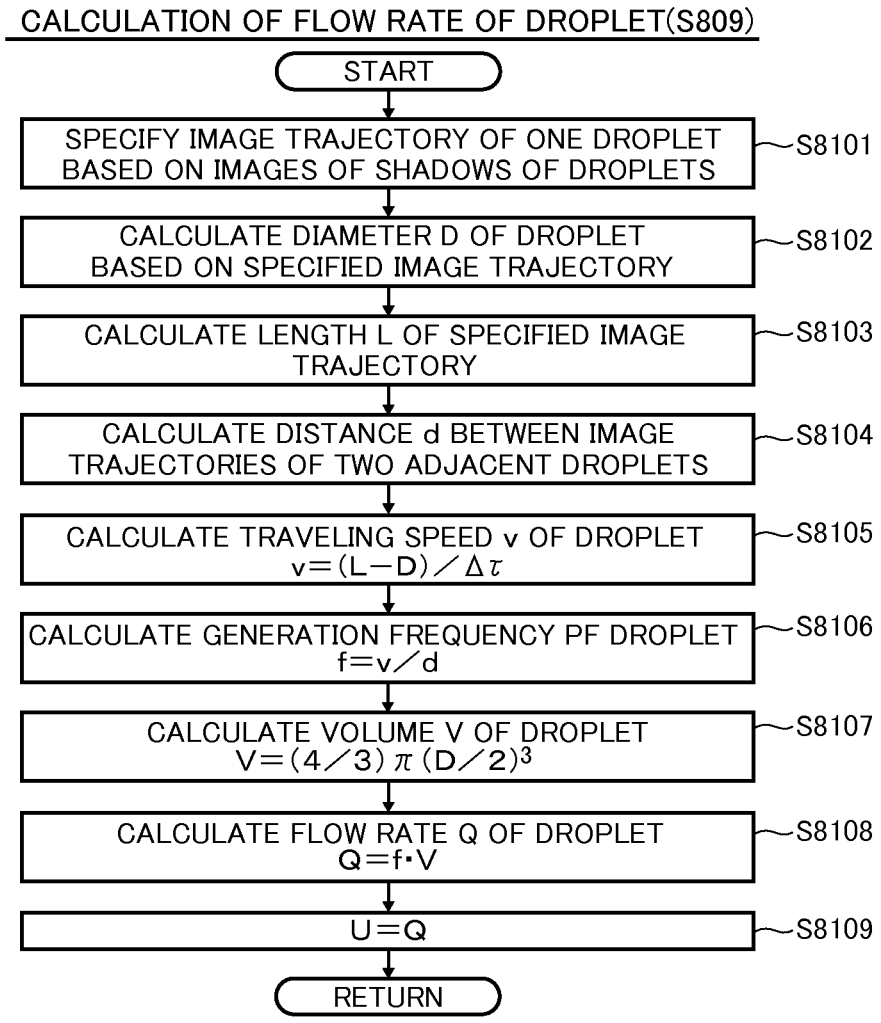
FIG. 14A is a flowchart showing a process for calculating the flow rate of a droplet, as the process for calculating a parameter of a droplet shown in FIG. 12.
Figure 14B:
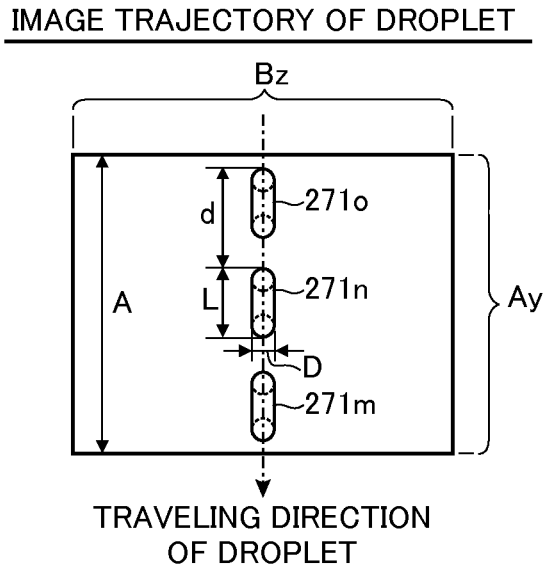
FIG. 14B schematically shows a picture of droplets captured by the imaging part of the target generation system included in the EUV light generation apparatus according to Embodiment 3.

FIG. 14A shows an exemplary process for calculating the flow rate Q of the droplets 271, as an example of the process for calculating the parameter U in the step S809 shown in FIG. 12. FIG. 14B schematically shows a picture of the droplets 271 captured by the image sensor 412*a* of the imaging part 412. Droplets 271*m* to 2710 shown in FIG. 14B may correspond to a plurality of droplets 271 sequentially outputted into the chamber 2. Here, the process shown in FIG. 14A may be performed together with the process shown in FIG. 13A.

Step S8101 to step S8105 performed by the droplet measurement controller 414 may be the same as the step S8091 to the step S8095 shown in FIG. 13A.

In step S8106, the droplet measurement controller 414 may calculate the generation frequency f of the droplets 271, based on the distance d calculated in the step S8104 and the traveling speed v calculated in the step S8105. The droplet measurement controller 414 may calculate the generation frequency f of the droplets 271 according to the following equation.

$$f=v/d$$

In step S8107, the droplet measurement controller 414 may calculate the volume V of the droplet 271, based on the diameter D of the droplet 271 calculated in the step S8102. The droplet measurement controller 414 may calculate the volume V of the droplet 271 according to the following equation.

$$V=(4/3)\pi(D/2)^3$$

In step S8108, the droplet measurement controller 414 may calculate the flow rate Q of the droplets 271, based on the generation frequency f calculated in the step S8106 and the volume V calculated in the step S8107. The droplet measurement controller 414 may calculate the flow rate Q of the droplets 271 according to the following equation.

$$Q=f\cdot V$$

In step S8109, the droplet measurement controller 414 may store the flow rate Q of the droplets 271 calculated in the step S8108, as the parameter U=Q.

Here, the average value of the flow rate Q calculated by the process shown in FIG. 14A is obtained by the calculation as shown in FIG. 12. After that, the flow rate Q may be outputted from the droplet measurement unit 41 including the droplet measurement controller 414 to the target generation device 7 including the target generation controller 74 as shown in FIG. 12. The target generation device 7 may read the outputted flow rate Q, and determine the pressure setting value to be set in the pressure regulator 721, based on the difference between the flow rate Q and the targeted flow rate Qt, by the process shown in FIG. 6. Then, the target generation device 7 may regulate the pressure in the tank 261 at the determined pressure setting value, and therefore regulate the pressure applied to the target 27.

7.3 Effect

The EUV light generation apparatus 1 according to Embodiment 3 can correctly measure whether or not the traveling speed v and the flow rate Q of the droplets 271 actually outputted into the chamber 2 are maintained in a uniform state. Then, the EUV light generation apparatus 1 may make the feedback of the measured traveling speed v and flow rate Q to regulate the pressure to be applied to the target 27 in the tank 261. By this means, the EUV light generation apparatus 1 according to Embodiment 3 may stabilize the traveling speed v and the flow rate Q of the droplets 271 actually outputted into the chamber 2 at the respective targeted values in real time during the operation of the EUV light generation apparatus 1.

By stabilizing the traveling speed v as described above, the EUV light generation apparatus 1 may supply the droplets 271 to the plasma generation region 25 in the chamber 2 at a constant speed. By this means, the EUV light generation apparatus 1 can allow the timing of the supply of the droplet 271 and the timing of the emission of the pulsed laser beam 33 to be easily synchronized. As a result, the EUV light generation apparatus 1 can stably generate the EUV light 252. In addition, by stabilizing the flow rate Q as described above, the EUV light generation apparatus 1 may supply the droplets 271 to the plasma generation region 25 in the chamber 2 at a constant flow rate. Therefore, the EUV light generation apparatus 1 can stably generate the EUV light 252.

Figure 15:
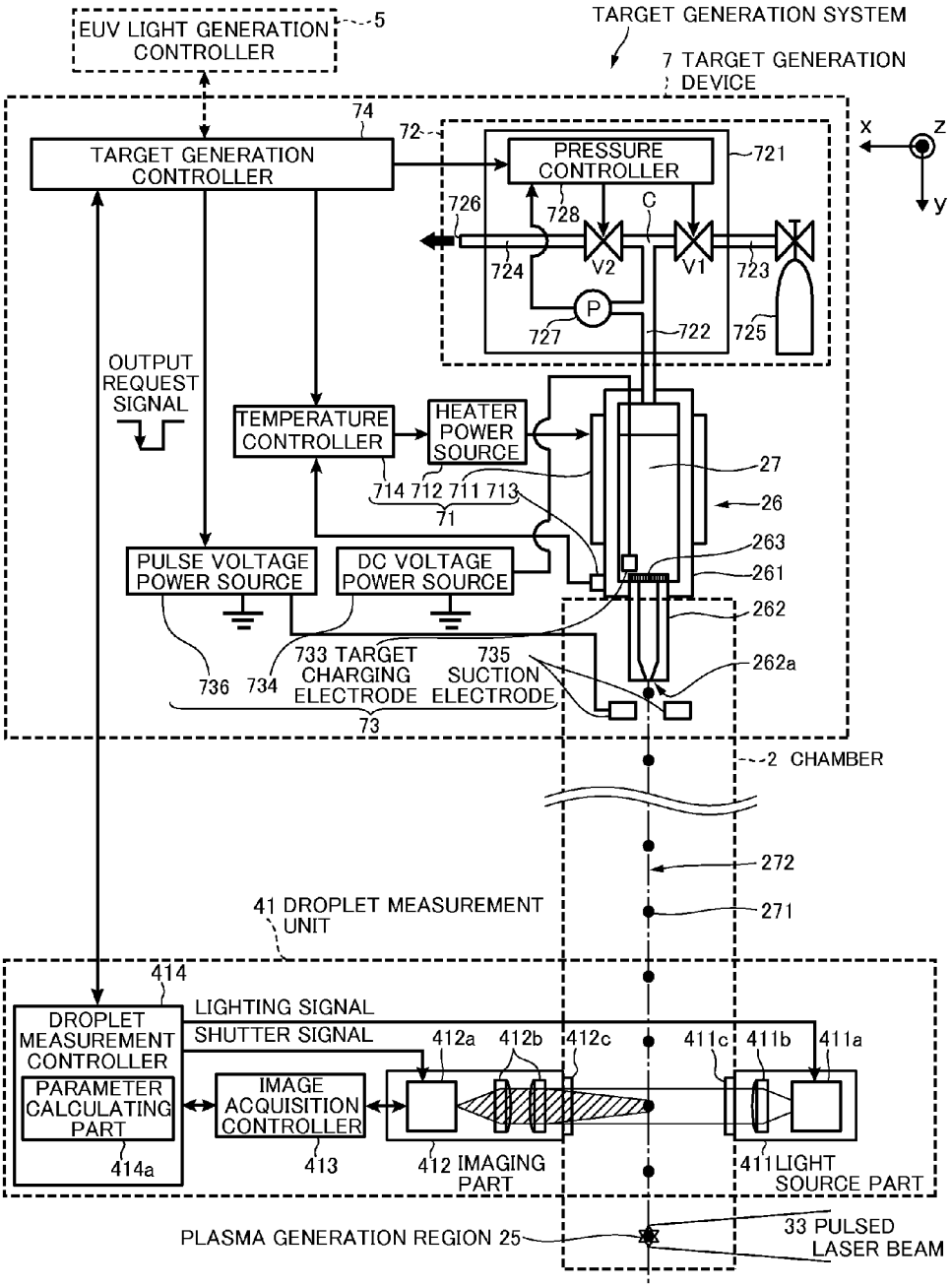
FIG. 15 shows the configuration of the target generation system included in the EUV light generation apparatus according to a variation of a droplet forming mechanism.
Figure 16:
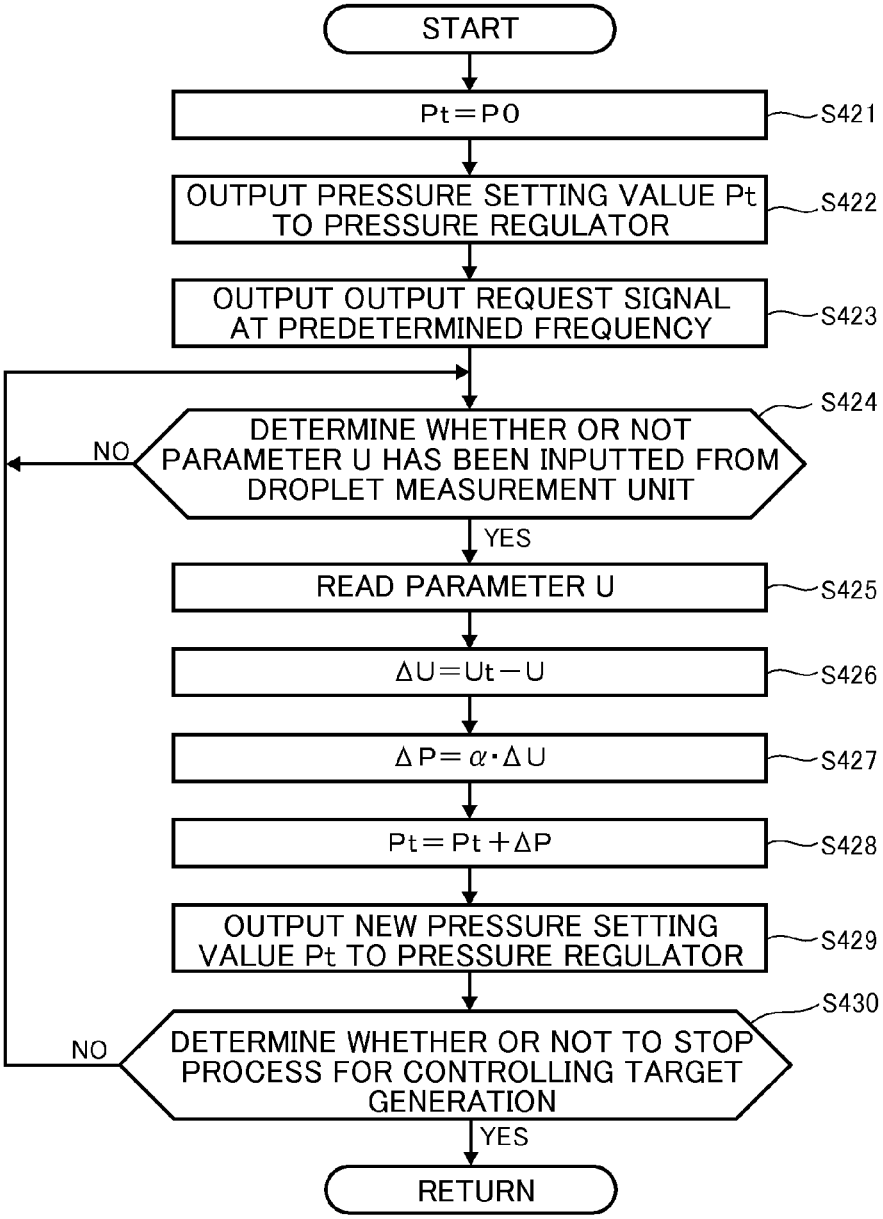
FIG. 16 is a flowchart showing a process for controlling target generation performed by the target generation controller shown in FIG. 15.

8. Target Generation System Included in the EUV Light Generation Apparatus According to a Modification of the Droplet Forming Mechanism Now, with reference to FIGS. 15 and 16, the target generation system included in the EUV light generation apparatus 1 according to a modification of the droplet forming mechanism 73 will be described. As shown in FIG. 15, the configuration of the target generation system included in the EUV light generation apparatus 1 according to the modification of the droplet forming mechanism 73 is different in the droplet forming mechanism 73, from that of Embodiment 1 shown in FIG. 5. The other configuration is the same as that of Embodiment 1, and therefore duplicate descriptions will be omitted. In addition, as shown in FIG. 16, the operation of the target generation system included in the EUV light generation apparatus 1 according to a modification of the droplet forming mechanism 73 is different in the process for controlling target generation, from that of Embodiment 1 shown in FIG. 6. The other operation is the same as that of Embodiment 1, and therefore duplicate descriptions will be omitted.

The droplet forming mechanism 73 according to Embodiment 1 as shown in FIG. 5 may form the droplets 271 by the continuous jet method. Meanwhile, the droplet forming mechanism 73 according to the modification shown in FIG. 15 may form the droplets 271 by the electrostatic suction method. The droplet forming mechanism 73 according to the modification shown in FIG. 15 may include a target charging electrode 733, a DC voltage power source 734, a suction electrode 735, and a pulse voltage power source 736.

The target charging electrode 733 may contact the target 27 in the tank 261, or be fixed in the vicinity of the nozzle 262. The target charging electrode 733 may be connected to the DC voltage power source 734. The DC voltage power source 734 may apply a voltage to the target charging electrode 733. By this means, it is possible to also apply a voltage to the target 27 in contact with the target charging electrode 733.

The suction electrode 735 may be formed in a circular ring shape. The suction electrode 735 may be provided to be spaced from the nozzle hole 262*a* on the target traveling path 272. The central axis of the circular ring-shaped suction electrode 735 and the central axis of the nozzle hole 262*a* may be placed on the same straight line. The suction electrode 735 may be connected to the pulse voltage power source 736. The pulse voltage power source 736 may apply a pulse voltage to the suction electrode 735. The suction electrode 735 to which the pulse voltage has been applied may generate an electrostatic force between the target 27 and the suction electrode 735. Due to the generation of the electrostatic force between the target 27 and the suction electrode 735, the target 27 may protrude from the nozzle hole 262*a*, and then be divided. The divided target 27 may form a free interface due to its surface tension, and therefore a droplet 271 may be formed. In this case, the droplet 271 may be electrically charged.

The pulse voltage power source 736 may be connected to the target generation controller 74. The target generation controller 74 may output an output request signal to the pulse voltage power source 736 at the timing at which the droplet 271 should be outputted into the chamber 2. The pulse voltage power source 736 may apply a pulse voltage to the suction electrode 735, based on the output request signal from the target generation controller 74.

With the electrostatic suction method, a pulse voltage is applied to the suction electrode 735 at a given timing in order to generate an electrostatic force between the suction electrode 735 and the target 27, so that it is possible to output the droplet 271 at a given timing. Moreover, with the electrostatic suction method, an electrostatic force between the suction electrode 735 and the target 27 is conceivable as an external force applied to the target 27 in the tank 261, as well as the pressure by the pressure regulating mechanism 72. Meanwhile, with the continuous jet method, it is not possible to generate an electrostatic force, as an external force applied to the target 27 in the tank 261. Therefore, with the electrostatic suction method, it is possible to reduce the pressure to be applied to the target 27 by the pressure regulating mechanism 72, compared to the continuous jet method.

Figure 4:
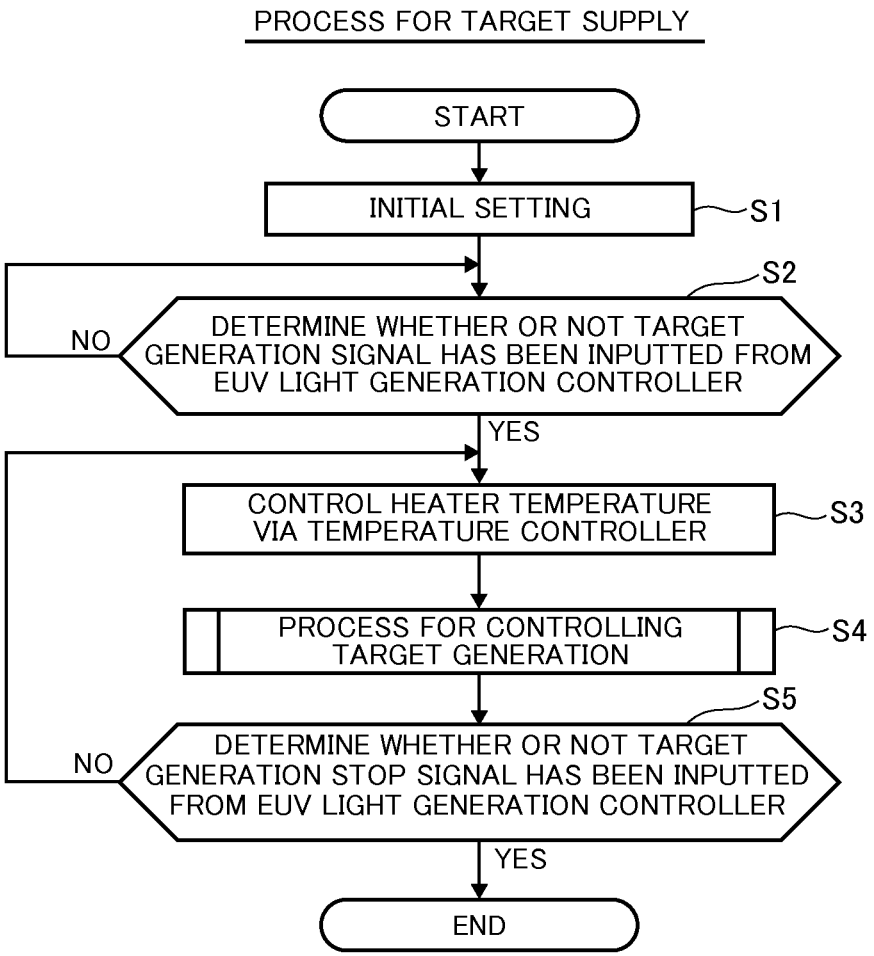
FIG. 4 is a flowchart showing a process for target supply performed by a target generation controller.

Upon receiving the target generation signal outputted from the EUV light generation controller 5, the target generation controller 74 performs the process for target supply shown in FIG. 4. Then, the target generation controller 74 performs the process for controlling target generation in the step S4 shown in FIG. 4. Now, with reference to FIG. 16, a process for controlling target generation performed by the target generation controller 74 according to the modification of the droplet forming mechanism 73 will be described.

In step S421, the target generation controller 74 may set the pressure setting value Pt to be set in the pressure regulator 721 as P0. P0 may be a pressure value corresponding to the targeted value Ut of the parameter. P0 may be, for example, from 1 MPa to 5 MPa.

In step S422, the target generation controller 74 may output the pressure setting value Pt set in the step S421 to the pressure regulator 721. The pressure regulator 721 may supply inert gas from the gas bomb 725 into the tank 261 according to the pressure setting value Pt. The pressure is applied to the molten target 27 in the tank 261, so that the molten target 27 may protrude from the nozzle hole 262*a*.

In step S423, the target generation controller 74 may output an output request signal to the pulse voltage power source 736 at a predetermined frequency. This predetermined frequency may be a frequency to generate the droplets 271 at a predetermined generation frequency f. The predetermined generation frequency f may be, for example, from 50 kHz to 100 kHz. Upon receiving the output request signal at the predetermined frequency, the pulse voltage power source 736 may apply a pulse voltage to the suction electrode 735 at the predetermined frequency. When the pulse voltage is applied to the suction electrode 735 at the predetermined frequency, an electrostatic force may be generated between the suction electrode 735 and the target 27 at the predetermined frequency. If the target 27 protrudes from the nozzle hole 262*a*, the target 27 is divided due to the electrostatic force generated at the predetermined frequency, so that the droplet 271 is formed.

Step S424 to step S430 performed by the target generation controller 74 may be the same as the steps S404 to S410 shown in FIG. 6.

The process for droplet measurement and the process for parameter calculation, which are performed by the droplet measurement controller 414 according to the modification of the droplet forming mechanism 73, may be the same as those of Embodiment 1 shown in FIGS. 7 to 9.

The EUV light generation apparatus 1 according to the modification of the droplet forming mechanism 73 can form the droplets 271 by the electrostatic suction method, and therefore can reduce the pressure to be applied to the target 27 in the tank 261. Therefore, when regulating the pressure to be applied to the target 27 based on the result of the measurement of the parameter, the EUV light generation apparatus 1 according to the modification of the droplet forming mechanism 73 can easily achieve a desired pressure value even if an amount of correction of the pressure is small. By this means, the EUV light generation apparatus 1 according to the modification of the droplet forming mechanism 73 can quickly stabilize the parameter of the droplets 271 actually outputted into the chamber 2 at the targeted value.

9. Target Generation System Included in the EUV Light Generation Apparatus According to Embodiment 4

9.1 Configuration

Now, with reference to FIG. 17, the configuration of the target generation system included in the EUV light generation apparatus 1 according to Embodiment 4 will be described.

As described above, the EUV light generation apparatus 1 according to Embodiment 1 to Embodiment 3 can measure the parameters for the state of a plurality of droplets 271 actually outputted into the chamber 2. Then, the EUV light generation apparatus 1 according to Embodiments 1 to 3 can control the pressure regulator 721 based on the result of the measurement to maintain the state of the droplets 271 actually outputted into the chamber 2 in a uniform state. By this means, the EUV light generation apparatus 1 according to Embodiment 1 to Embodiment 3 can stably generate the EUV light 252. Meanwhile, when the pressure regulator 721 is controlled, there is a time lag from when the target generation controller 74 sets the pressure setting value Pt in the pressure regulator 721 until the actual pressure in the tank 261 reaches the pressure setting value Pt. During the time lag, the traveling speed v of the droplets 271 may fluctuate and not be a constant value. Therefore, during the time lag, the timing of the supply of the droplet 271 to the plasma generation region 25 and the timing of the emission of the pulsed laser beam 33 may not be synchronized. The EUV light generation apparatus 1 according to Embodiment 4 may allow the timing of the supply of the droplet 271 to the plasma generation region 25 and the timing of the emission of the pulsed laser beam 33 to be synchronized.

The target generation system included in the EUV light generation system 1 according to Embodiment 4 may include the droplet measurement unit 41, a droplet timing measurement unit 42, a delay circuit 82, and the target generation device 7. The configuration of the target generation device 7 is the same as that of Embodiment 1 to Embodiment 3, and therefore duplicate descriptions will be omitted.

The droplet timing measurement unit 42 may measure the timing at which the droplet 271 outputted into the chamber 2 passes through a predetermined position P. The predetermined position P may be spaced from the plasma generation region 25 to the target supplier 26 side by a distance H, along the target traveling path 272. The droplet timing measurement unit 42 may include a light source part 421 and a light receiving part 422.

The light source part 421 and the light receiving part 422 may be placed to face to one another via the target traveling path 272. The direction in which the light source part 421 and the light receiving part 422 face to one another may be orthogonal to the target traveling path 272.

The light source part 421 may emit continuous light to the droplets 271 traveling through the target traveling path 272. The continuous light emitted to the droplets 271 may be a continuous laser beam. The light source part 421 may include a light source 421*a*, an illumination optical system 421*b*, and a window 421*c*.

The light source 421*a* may be, for example, a CW (continuous wave) laser oscillator that emits a continuous laser beam.

The illumination optical system 421*b* may include a lens and so forth. The lens may be, for example, a cylindrical lens. The illumination optical system 421*b* may focus the continuous laser beam emitted from the light source 421*a* onto the predetermined position P on the target traveling path 272 via the window 421*c*. The size of the continuous laser beam focused on the predetermined position P may be sufficiently greater than the diameter (e.g. 20 μm) of the droplet 271.

The light receiving part 422 may receive the continuous laser beam emitted from the light source part 421, and detect the optical intensity of the continuous laser beam. The light receiving part 422 may include an optical sensor 422*a*, a light receiving optical system 422*b*, and a window 422*c*.

The light receiving optical system 422*b* may include a collimator, or be formed by an optical element such as a lens. The light receiving optical system 422*b* may guide the continuous laser beam emitted from the light source part 421 to the optical sensor 422*a* via the window 422*c*.

The optical sensor 422*a* may be a light receiving element including a photodiode. The optical sensor 422*a* may detect the optical intensity of the continuous laser beam guided by the light receiving optical system 422*b*. The optical sensor 422*a* may be connected to the droplet measurement controller 414 of the droplet measurement unit 41 and the delay circuit 82. The optical sensor 422*a* may output a detection signal of the detected optical intensity to the droplet measurement controller 414 and the delay circuit 82.

With the above-described configuration, the light source part 421 can emit the continuous laser beam to the predetermined position P on the target traveling path 272. When the droplet 271 traveling on the target traveling path 272 passes through the predetermined position P, the droplet 271 may be irradiated with the continuous laser beam emitted from the light source part 421. The light receiving part 422 may detect the optical intensity of the continuous laser beam emitted from the light source part 421. When the droplet 271 passes through the predetermined position P on the target traveling path 272, the light receiving part 422 may detect the optical intensity of the continuous laser beam covered with this droplet 271 being reduced. The light receiving part 422 may output the detection signal responsive to the reduction in the optical intensity due to the passage of the droplet 271, to the droplet measurement controller 414 and the delay circuit 82. Here, the detection signal responsive to the reduction in the optical intensity due to the passage of the droplet 271 may be referred to as "droplet passing signal."

As described above, the droplet timing measurement unit 42 may measure the timing at which the droplet 271 outputted into the chamber 2 passes through the predetermined position P. At this timing, the droplet timing measurement unit 42 may output the droplet passing signal to the droplet measurement controller 414 and the delay circuit 82. Here, the timing at which the droplet 271 outputted into the chamber 2 passes through the predetermined position P may be referred to as "passing timing."

The delay circuit 82 may output "trigger signal" to the laser device 3 at the timing that is delayed by "delay time Td" from when the droplet passing signal is outputted. The trigger signal outputted from the delay circuit 82 may be a signal that triggers laser oscillation of the laser device 3 to output the pulsed laser beam 31. The delay time Td may be defined to synchronize the timing at which the pulsed laser beam 33 is focused on the plasma generation region 25 with the timing at which the droplet 271 reaches the plasma generation region 25. That is, the delay time Td may be defined to synchronize the timing of the emission of the pulsed laser beam 33 with the timing of the supply of the droplet 271 to the plasma generation region 25. By this means, when the droplet 271 having passed through the predetermined position P on the target traveling path 272 reaches the plasma generation region 25, the droplet 271 can be irradiated with the pulsed laser beam 33. The delay time Td may be calculated by the droplet measurement controller 414 and set in the delay circuit 82.

The droplet measurement controller 414 included in the droplet measurement unit 41 may calculate the parameter U of the droplets 271, based on the image data outputted from the image acquisition controller 413. Particularly, the droplet measurement controller 414 may calculate the traveling speed v of the droplets 271, based on the image data outputted from the image acquisition controller 413. The droplet measurement controller 414 may calculate the generation frequency f of the droplets 271, based on the inputted droplet passing signal. The droplet measurement controller 414 may calculate the delay time Td, based on the traveling speed v and the generation frequency f of the droplets 271. The droplet measurement controller 414 may set the calculated delay time Td in the delay circuit 82. Here, the other configuration of the droplet measurement unit 41 is the same as those of Embodiment 1 to Embodiment 3, and therefore duplicate descriptions will be omitted.

9.2 Operation

Figure 18:
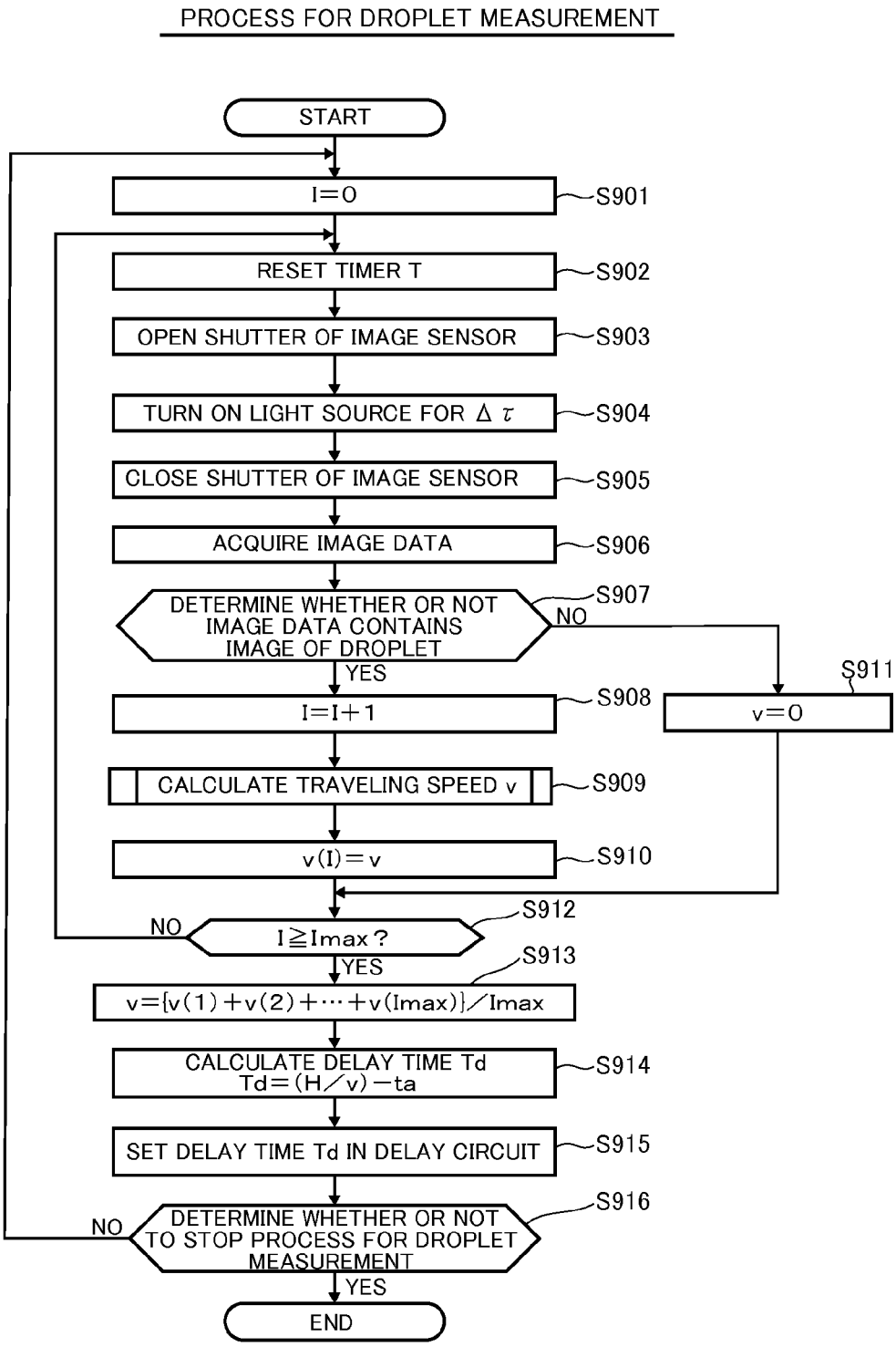
FIG. 18 is a flowchart showing a process for droplet measurement performed by the droplet measurement controller shown in FIG. 17.
Figure 19:
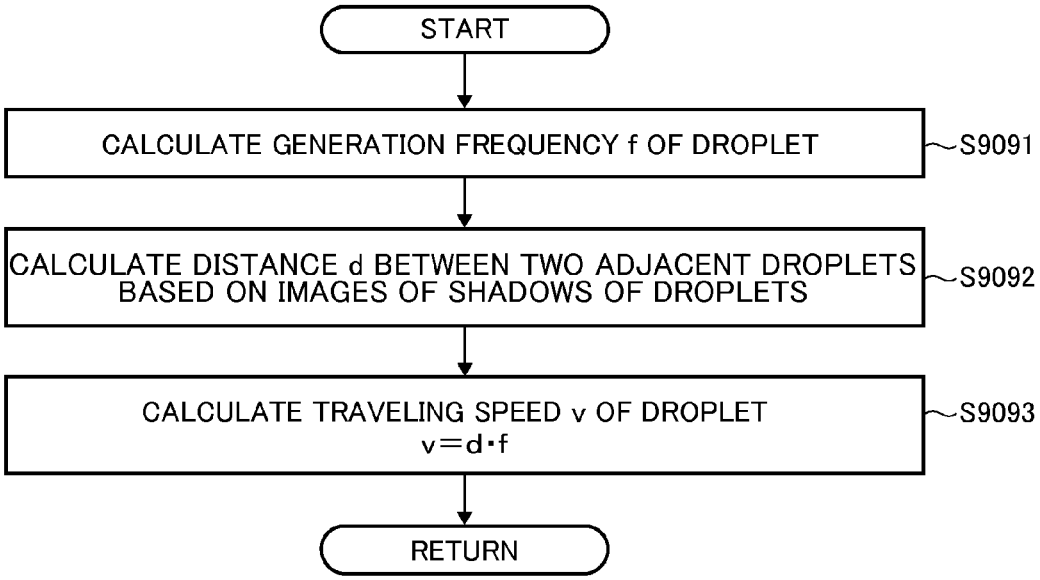
FIG. 19 is a flowchart showing details of a process for calculating the traveling speed of a droplet shown in FIG. 18.

Now, with reference to FIGS. 18 and 19, the operation of the target generation system included in the EUV light generation apparatus 1 according to Embodiment 4 will be described. As shown in FIGS. 18 and 19, the operation of the target generation system included in the EUV light generation apparatus 1 according to Embodiment 4 is different in the process for droplet measurement and the process for calculating the parameter U, from the operation of Embodiment 1 to Embodiment 3 shown in FIGS. 7 to 14B. The other operation is the same as that of Embodiment 1 to Embodiment 3, and therefore duplicate descriptions will be omitted.

With reference to FIG. 18, the process for droplet measurement performed by the droplet measurement controller 414 will be described. The droplet measurement controller 414 may perform the following process as the process for droplet measurement, without a command from the target generation controller 74. The process for controlling target generation performed by the target generation controller 74 shown in FIG. 6 and the process for droplet measurement performed by the droplet measurement controller 414 shown in FIG. 18 may be performed in parallel. In addition, the droplet measurement controller 414 may perform the process for droplet measurement shown in FIG. 18 and the process for droplet measurement shown in FIGS. 7, 10 and 12 in parallel.

In step S901, the droplet measurement controller 414 may reset a passing number I, which is the number of droplets 271 having passed through the predetermined position P in the chamber 2, as I=0. The droplet measurement controller 414 may receive the droplet passing signal from the droplet timing measurement unit 42 every time the droplet 271 passes through the predetermined position P in the chamber 2. The droplet measurement controller 414 may recognize the number of droplets 271 and the timing of the passage of the droplet 271 having passed through the predetermined position P, based on the number of times and the timings at which the droplet passing signals are inputted. The droplet measurement controller 414 may reset the value of the passing number I, before counting the number of droplets 271 having passed through the predetermined position P.

Step S902 to step S907 performed by the droplet measurement controller 414 may be the same as the steps S602 to S607 shown in FIG. 7. When determining that the acquired image data contains the droplet 271, the droplet measurement controller 414 may move the step to step S908. On the other hand, when determining that the acquired image data does not contain any droplet 271, the droplet measurement controller 414 may move the step to step S911.

In the step S908, the droplet measurement controller 414 may update the passing number I, which is the number of droplets 271 having passed through the predetermined position P in the chamber 2. The droplet measurement controller 414 may update the passing number I by increment according to the following equation, every time the droplet passing signal is inputted.

$$I=I+1$$

In step S909, the droplet measurement controller 414 may calculate the traveling speed v of the droplets 271, as the parameter U of the droplets 271 contained in the image data acquired in the step S906. Here, the process for calculating the traveling speed v of the droplets 271 will be described later with reference to FIG. 19.

In step S910, the droplet measurement controller 414 may store the traveling speed v calculated in the step S909, which is one of the parameters U of the droplets 217, as v(I)=v. v(I) may be the value obtained by which the traveling speed v calculated in the step S909 is associated with the passing number I updated in the step S908. The droplet measurement controller 414 may store the values of the plurality of traveling speeds v currently and previously calculated, in association with the values of the passing numbers I for each of the calculations of the values of the plurality of traveling speeds v.

In step S911, the droplet measurement controller 414 may set the traveling speed v as v=0. When the image data acquired in the step S906 does not contain any droplet 271, the droplet measurement controller 414 may regard the traveling speed v of the droplets 271 as v=0.

In step S912, the droplet measurement controller 414 may determine whether or not the passing number I updated in the step S908 is equal to or greater than Imax. Imax may be a threshold representing the passing number I which is necessary to calculate the average value of the traveling speeds v of the droplets 271 having passed through the predetermined position P. Imax may be a value which is predefined by using a statistic technique, in consideration of the variation of the traveling speeds v. When determining that the passing number I is equal to or greater than Imax, the droplet measurement controller 414 may move the step to step S913. On the other hand, when determining that the passing number I is not equal to or greater than Imax, the droplet measurement controller 414 may move the step back to the step S902.

In the step S913, the droplet measurement controller 414 may calculate the average value of the traveling speeds v. The droplet measurement controller 414 may calculate the average value of the traveling speeds v according to the following equation.

$$v=\{v(1)+v(2)+\ldots+v(I\max)\}/I\max$$

In step S914, the droplet measurement controller 414 may calculate the delay time Td to be set in the delay circuit 82, by using the average value of the traveling speeds v calculated in the step S913. The droplet measurement controller 414 may calculate the delay time Td as follows.

First, the droplet measurement controller 414 may calculate a time t1 from when the droplet 271 outputted into the chamber 2 has passed through the predetermined position P until reaching the plasma generation region 25 according to the following equation.

$$t1=H/v \quad \text{(A)}$$

Here, "v" in the right-hand side may represent the average value of the traveling speeds v calculated in the step S913. "H" in the right-hand side may represent the distance from the predetermined position P to the plasma generation region 25. When calculating the delay time Td, the droplet measurement controller 414 may improve the accuracy of the calculation of the delay time Td, by using the average value of the plurality of traveling speeds v currently and previously calculated. Next, the droplet measurement controller 414 may calculate the delay time Td to be set in the delay circuit 82 according to the following equation, by using "t1" calculated by the above equation.

$$Td=t1-ta \quad \text{(B)}$$

Here, "ta" in the right-hand side may be a period of time required from when the delay circuit 82 has outputted a trigger signal to the laser device 3 until the pulsed laser beam 33 is focused on the plasma generation region 25. That is, the pulsed laser beam 33 may be focused on the plasma generation region 25 at the timing that has elapsed by "delay time Td+time ta" after the droplet passing signal is outputted. By substituting the equation (A) for the equation (B), the droplet measurement controller 414 may calculate the delay time Td according to the following equation.

$$Td=(H/v)-ta$$

In step S915, the droplet measurement controller 414 may set the delay time Td calculated in the step S914 in the delay circuit 82. By setting the delay time Td in the delay circuit 82, the droplet measurement controller 414 may control the timing of the emission of the pulsed laser beam 33, based on the timing of the passage of the droplet 271.

In step S916, the droplet measurement controller 414 may determine whether or not to stop the process for droplet measurement. The droplet measurement controller 414 may stop the process for droplet measurement shown in FIG. 18 once in the following situations. As an example of the situations in which the process for droplet measurement is stopped, it is conceivable that the period of time has elapsed, which is required from when the target generation controller 74 sets the pressure setting value Pt in the pressure regulator 721 until the actual pressure in the tank 261 reaches the pressure setting value Pt. As another example, it is conceivable that an error occurs due to an unforeseen circumstance. When determining not to stop the process for droplet measurement, the droplet measurement controller 414 may move the step back to the step S901. On the other hand, when determining to stop the process for droplet measurement, the droplet measurement controller 414 may end the process.

Here, Imax used in the step S912 shown in FIG. 18 may be a value smaller than Nmax (100 to 1000) used in the step S612 shown in FIG. 7. Imax may be defined as, for example, Imax=1. If Imax is a smaller value, the droplet measurement controller 414 may frequently calculate the delay time Td and set the calculated value in the delay circuit 82. Then, the timing of the output of a trigger signal from the delay circuit 82 to the laser device 3 may be frequently adjusted. Then, the timing of the emission of the pulsed laser beam 33 to the plasma generation region 25 may be frequently adjusted. Therefore, if Imax is a smaller value, the droplet measurement controller 414 may adjust the timing of the emission of the pulsed laser beam 33 immediately in response to the change in the traveling speed v of the droplet 271. That is, when Imax is a smaller value, the droplet measurement controller 414 may quickly synchronize the timing of the emission of the pulsed laser beam 33 with the change in the timing of the supply of the droplet 271 to the plasma generation region 25. As described above, the droplet measurement controller 414 may perform the process for droplet measurement shown in FIG. 18 in parallel with the process for droplet measurement shown in FIGS. 7, 10 and 12. In this case, it is preferred that Imax is set as Imax<Nmax.

With reference to FIG. 19, a process performed by the droplet measurement controller 414 according to Embodiment 4 for calculating the traveling speed v, which is one of the parameters U of the droplet 271, will be described. FIG. 19 shows an exemplary process for calculating the traveling speed v of the droplets 271 in the step S909 of FIG. 18.

In step S9091, the droplet measurement controller 414 may calculate the generation frequency f of the droplets 271. As described above, the droplet measurement controller 414 may receive a droplet passing signal from the droplet timing measurement unit 42 every time the droplet 271 passes through the predetermined position P in the chamber 2. The droplet measurement controller 414 may determine the number of times at which the droplet passing signals are inputted per unit of time as the generation frequency f of the droplets 271. In this case, it is preferred that Imax is defined as Imax≥2. In a case of I=1, the step S909 shown in FIG. 18 may be skipped as v(1)=0. Moreover, in the step S913, the following equation may be used.

$$v=\{v(2)+\ldots+v(I\max)\}/(I\max-1)$$

Moreover, as described about the step S403 shown in FIG. 6, the target generation controller 74 may cause the piezoelectric power source 732 to supply electric power having a determined waveform to the piezoelectric element 731 so as to generate the droplets 271 at the predetermined generation frequency f. Here, the droplet measurement controller 414 may receive information on the predetermined generation frequency f used to control the power supply to the piezoelectric element 731 from the target generation controller 74, and determine the information as the generation frequency f of the droplets 271 calculated in the step S9091. Alternatively, the droplet measurement controller 414 may previously store information on a predetermined generation frequency f and determine the information as the generation frequency f of the droplets 271 calculated in the step S9091.

In step S9092, the droplet measurement controller 414 may calculate the distance d between two adjacent droplets 271, based on the images of the shadows of the droplets 271 contained in the image data acquired in the step S906 shown in FIG. 18.

In step S9093, the droplet measurement controller 414 may calculate the traveling speed v of the droplets 271. The droplet measurement controller 414 may calculate the traveling speed v of the droplets 271 by using the generation frequency f calculated in the step S9091 and the distance d calculated in the step S9092, according to the following equation.

$$v=d\cdot f$$

After having stored the calculated traveling speed v, the droplet measurement controller 414 may end the process.

In order to calculate the traveling speed v of the droplets 271, the droplet measurement controller 414 may perform the process shown in FIG. 13A instead of the process shown in FIG. 19.

Here, the average value of the traveling speed v calculated by the process shown in FIG. 19 is obtained by the calculation as shown in FIG. 18. After that, the traveling speed v may be outputted from the droplet measurement unit 41 including the droplet measurement controller 414 to the target generation device 7 including the target generation controller 74 as shown in FIG. 18. The target generation controller 7 may read the outputted traveling speed v by the process shown in FIG. 6, and determine the pressure setting value to be set in the pressure regulator 721, based on the difference between the traveling speed v and the targeted traveling speed vt. The targeted traveling speed vt may be, for example, from 50 m/s to 100 m/s. Then, the target generation device 7 may regulate the pressure in the tank 261 at the determined pressure setting value, and therefore regulate the pressure applied to the target 27. That is, the EUV light generation apparatus 1 according to Embodiment 4 can control both the timing of the emission of the pulsed laser beam 33 and the pressure regulator 721, based on the traveling speed v of the droplets 271, which is one of the parameters U measured by the droplet measurement unit 41.

9.3 Effect

The EUV light generation apparatus 1 according to Embodiment 4 may correctly measure whether or not the traveling speed v of the droplets 271 actually outputted into the chamber 2 is maintained in a uniform state. Then, even if the measured traveling speed v is changed, the EUV light generation apparatus 1 may adjust the timing of the emission of the pulsed laser beam 33 immediately in response to the change. That is, the EUV light generation apparatus 1 according to Embodiment 4 may quickly synchronize the timing of the emission of the pulsed laser beam 33 with the change in the timing of the supply of the droplet 271 to the plasma generation region 25. By this means, even if the timing of the supply of a droplet 271 to the plasma generation region 25 is changed by the change in the traveling speed v, the EUV light generation apparatus 1 according to Embodiment 4 may emit the pulsed laser beam 33 to the droplet 271. Therefore, the EUV light generation apparatus 1 according to Embodiment 4 may adjust the timing of the emission of the pulsed laser beam 33 in real time during its operation, and therefore stably generate the EUV light 252. Particularly, even during the period of time for which the pressure in the tank 261 has not reached the pressure setting value Pt yet, the EUV light generation apparatus 1 may stably generate the EUV light 252 by adjusting the timing of the emission of the pulsed laser beam 33.

10. Others 10.1 Hardware Environment of Each Controller

A person skilled in the art would understand that the subject matters disclosed herein can be implemented by combining a general purpose computer or a programmable controller with a program module or a software application. In general, the program module includes routines, programs, components and data structures which can execute the processes disclosed herein.

Figure 20:
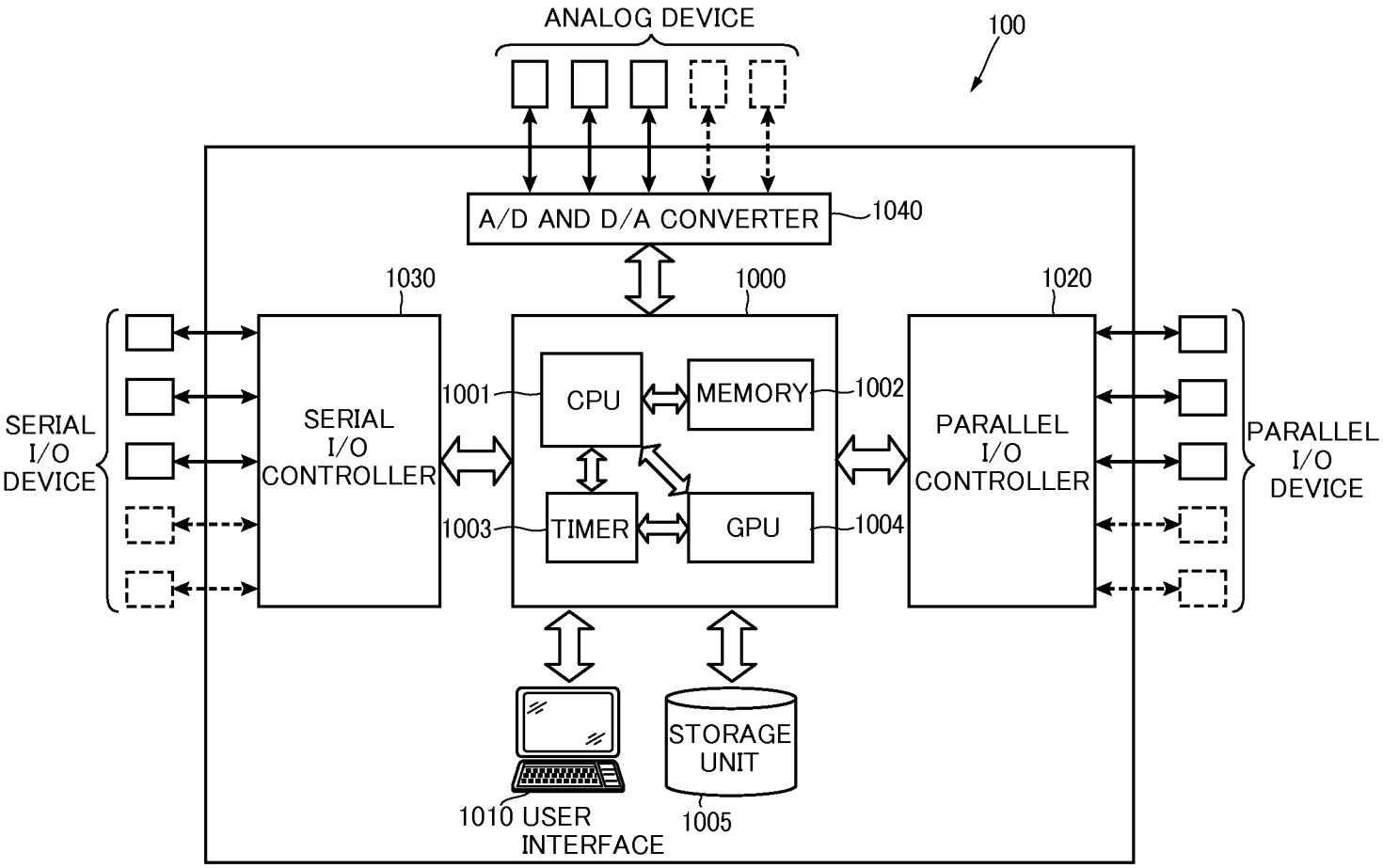
FIG. 20 is a block diagram showing the hardware environment of each controller.

FIG. 20 is a block diagram showing an exemplary hardware environment in which various aspects of the subject matters disclosed herein can be implemented. An exemplary hardware environment 100 shown in FIG. 20 may include a processing unit 1000, a storage unit 1005, a user interface 1010, a parallel I/O controller 1020, a serial I/O controller 1030, and an A/D and D/A converter 1040, but the configuration of the hardware environment 100 is not limited to this.

The processing unit 1000 may include a central processing unit (CPU) 1001, a memory 1002, a timer 1003, and a graphics processing unit (GPU) 1004. The memory 1002 may include a random access memory (RAM) and a read only memory (ROM). The CPU 1001 may be any of commercially available processors. A dual microprocessor or another multiprocessor architecture may be used as the CPU 1001.

The components shown in FIG. 20 may be interconnected with each other to perform the processes disclosed herein.

During its operation, the processing unit 1000 may read and execute the program stored in the storage unit 1005, read data together with the program from the storage unit 1005, and write the data to the storage unit 1005. The CPU 1001 may execute the program read from the storage unit 1005. The memory 1002 may be a work area in which the program executed by the CPU 1001 and the data used in the operation of the CPU 1001 are temporarily stored. The timer 1003 may measure a time interval and output the result of the measurement to the CPU 1001 according to the execution of the program. The GPU 1004 may process image data according to the program read from the storage unit 1005, and output the result of the process to the CPU 1001.

The parallel I/O controller 1020 may be connected to parallel I/O devices that can communicate with the processing unit 1000, such as the EUV light generation controller 5, the laser beam direction controller 34, the target generation controller 74, the temperature controller 714, the pressure controller 728, the image sensor 412*a*, the image acquisition controller 413, the delay circuit 82, and the droplet measurement controller 414. The parallel I/O controller 1020 may control the communication between the processing unit 1000 and those parallel I/O devices. The serial I/O controller 1030 may be connected to serial I/O devices that can communicate with the processing unit 1000, such as the heater power source 712, the piezoelectric power source 732, the light source 411*a*, the light source 421*a*, the DC voltage power source 734, and the pulse voltage power source 736. The serial I/O controller 1030 may control the communication between the processing unit 1000 and those serial I/O devices. The A/D and D/A converter 1040 may be connected to analog devices such as the temperature sensor 713, the pressure sensor 727, the target sensor 4, the optical sensor 422*a*, a vacuum gauge and various sensors via analog ports, may control the communication between the processing unit 1000 and those analog devices, and may perform A/D and D/A conversion of the contents of the communication.

The user interface 1010 may present the progress of the program executed by the processing unit 1000 to the operator, in order to allow the operator to command the processing unit 1000 to stop the program and to execute an interruption routine.

The exemplary hardware environment 100 may be applicable to the EUV light generation controller 5, the laser beam direction controller 34, the target generation controller 74, the temperature controller 714, the pressure controller 728, the image acquisition controller 413, and the droplet measurement controller 414 in the present disclosure. A person skilled in the art would understand that those controllers may be realized in a distributed computing environment, that is, an environment in which tasks are performed by the processing units connected to each other via a communication network. In this disclosure, the EUV light generation controller 5, the laser beam direction controller 34, the target generation controller 74, the temperature controller 714, the pressure controller 728, the image acquisition controller 413, and the droplet measurement controller 414 may be connected to each other via a communication network such as Ethernet or Internet. In the distributed computing environment, the program module may be stored in both of a local memory storage device and a remote memory storage device.

10.2 Another Modification

When the imaging time Δt of the image sensor 412*a* may be approximately the same as the lighting time Δτ of the light source 411*a*, the droplet measurement unit 41 may cause the light source 411*a* to emit continuous light. The light source 411*a* may be a laser beam source that outputs a continuous laser beam. In the droplet measurement unit 41, the light source part 411 and the imaging part 412 may not need to face to one another via the target traveling path 272. For example, the window 411*c* of the light source part 411 and the window 412*c* of the imaging part 412 may be arranged to face toward the same point but not be in parallel. The imaging part 412 may image the light reflected from the droplet 271, instead of the shadow of the droplet 271. The arrangement of the window 411*c* of the light source part 411 and the window 412*c* of the imaging part 412 is not limited as long as it allows the light reflected from the droplet 271 to be imaged.

In the droplet timing measurement unit 42, the light source part 421 and the light receiving part 422 may not need to face to one another via the target traveling path 272. For example, the window 421*c* of the light source part 421 and the window 422*c* of the light receiving part 422 may be arranged to face toward the same point but not be in parallel. In this case, the light receiving part 422 may detect the light reflected from the droplet 271. As described above, the window 421*c* of the light source part 421 and the window 422*c* of the light receiving part 422 may be arranged to be able to detect the light reflected from the droplet 271.

The shutter signal to control the opening and closing of the shutter of the image sensor 421*a* may be outputted from the image acquisition controller 413, instead of the droplet measurement controller 414.

The process for droplet measurement shown in FIGS. 7, 10, 12 and 18 may be executed as part of the process for controlling target generation shown in FIGS. 6 and 16. The target generation controller 74 may output a control signal to the droplet measurement controller 414 to command the start of the process for droplet measurement. The droplet measurement controller 414 may perform the process for droplet measurement according to the command from the target generation controller 74. The step of commanding the start of the process for droplet measurement by the target generation controller 74 may be performed, for example, just before the step S404 shown in FIG. 6.

Figure 17:
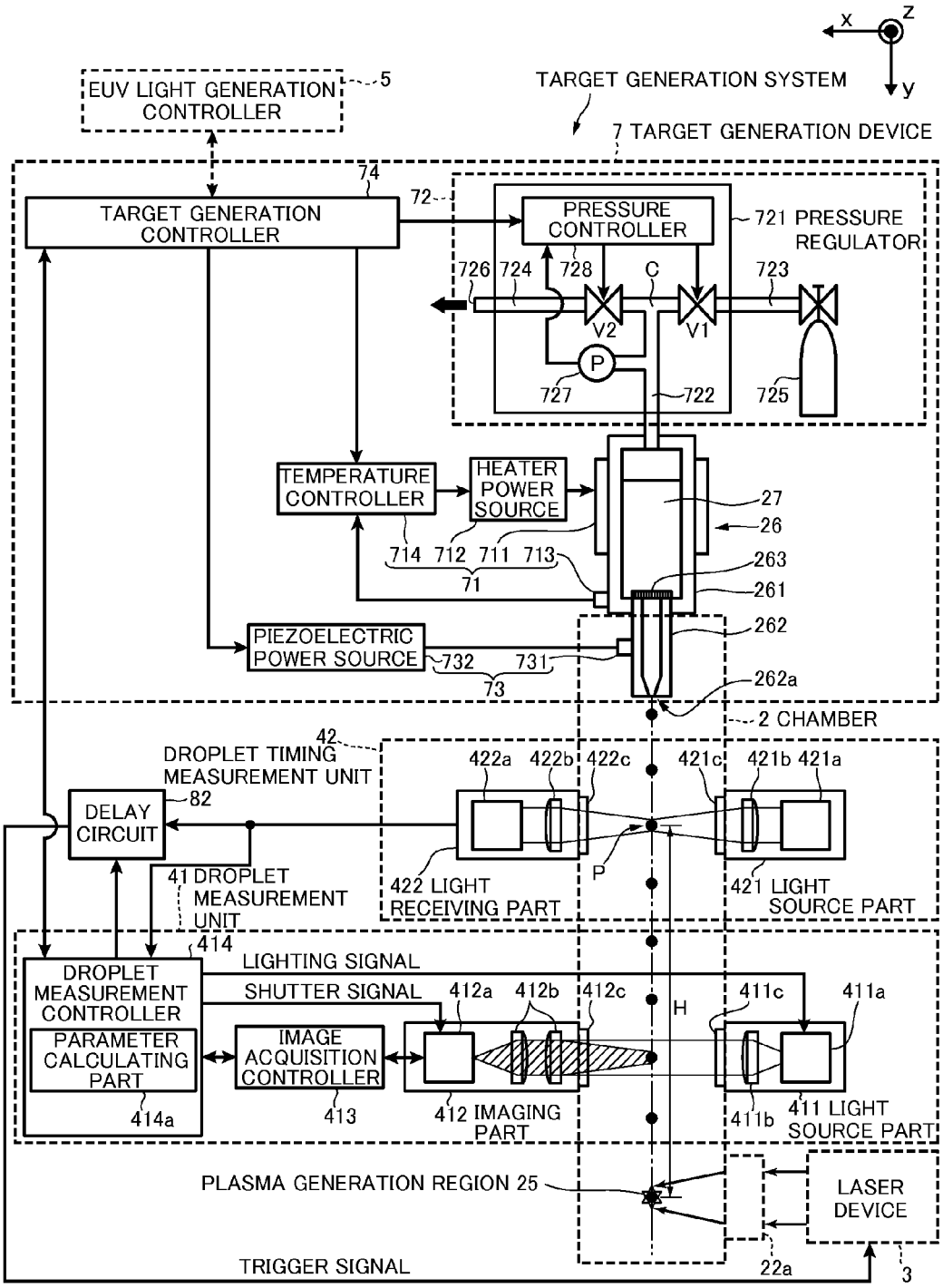
FIG. 17 shows the configuration of the target generation system included in the EUV light generation apparatus according to Embodiment 4.

With the EUV light generation apparatus 1 according to Embodiment 4 shown in FIGS. 17 to 19, the droplet measurement controller 414 calculates the delay time Td based on the traveling speed v of the droplets 271 calculated by the droplet measurement controller 414, and sets the calculated delay time Td in the delay circuit 82. That is, with the EUV light generation apparatus 1 according to Embodiment 4 shown in FIGS. 17 to 19, the droplet measurement controller 414 controls the timing of the emission of the pulsed laser beam 33, based on the traveling speed v of the droplets 271. However, with the EUV light generation apparatus 1 according to Embodiment 4, the droplet measurement controller 414 may output the information on the calculated traveling speed v of the droplets 271 to the target generation controller 74. In this case, the target generation controller 74 may be connected to the delay circuit 82. Upon receiving the information on the traveling speed v outputted from the droplet measurement controller 414, the target generation controller 74 may perform the same step as the step S914 shown in FIG. 18 to calculate the delay time Td. Then, the target generation controller 74 may perform the same step as the step S915 shown in FIG. 18 and set the calculated delay time Td in the delay circuit 82. That is, with the EUV light generation apparatus 1 according to Embodiment 4, the target generation controller 74 may control the timing of the emission of the pulsed laser beam 33, based on the traveling speed v calculated by the droplet measurement controller 414. By this means, the target generation controller 74 according to Embodiment 4 may control both the timing of the emission of pulsed laser beam 33 and the pressure regulator 721, based on the traveling speed v of the droplets 271 measured by the droplet measurement unit 41.

Part or all of the EUV light generation controller 5, the target generation controller 74, the temperature controller 714, the pressure controller 728, the image acquisition controller 413, the delay circuit 82, and the droplet measurement controller 414 may be combined to form as one controller.

It would be obvious to a person skilled in the art that the technologies described in the above-described embodiments including the modifications may be compatible with each other.

For example, the droplet measurement controller 414 according to Embodiment 1 calculates the diameter D and the distance d of the droplets 271 as a parameter, but may calculate other parameters. Parameters to be calculated may be appropriately selected for an apparatus to which the embodiments are applied. The same applies to the droplet measurement controller 414 according to Embodiments 2 to 4. Then, the target generation controller 74 according to Embodiments 1 to 4 may control the pressure regulator 721 based on the calculated parameters. Here, the droplet measurement controller 414 according to Embodiments 1 to 4 may calculate a plurality of parameters at one time. The target generation controller 74 according to Embodiments 1 to 4 may control the pressure regulator 721 based on those calculated parameters.

Although the droplet forming mechanism 73 according to Embodiments 1 to 4 employs the continuous jet method, the electrostatic suction method described in the modification of the droplet forming mechanism 73 is applicable.

The descriptions above are intended to be illustrative only and the present disclosure is not limited thereto. Therefore, it will be apparent to those skilled in the art that it is possible to make modifications to the embodiments of the present disclosure within the scope of the appended claims.

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

REFERENCE SIGNS LIST

1 EUV light generation apparatus
2 chamber
26 target supplier
27 target
271 droplet
41 droplet measurement unit
412 imaging part
414 droplet measurement controller
414*a* parameter calculating part
42 droplet timing measurement unit
5 EUV light generation controller
7 target generation device
721 pressure regulator
74 target generation controller

The invention claimed is:

1. An extreme ultraviolet light generation apparatus comprising:

a target supplier configured to sequentially supply targets to a plasma generation region in a chamber as a plurality of droplets at a predetermined generation frequency, the targets generating extreme ultraviolet light when being irradiated with a laser beam in the chamber;

a pressure regulator configured to regulate a pressure in the target supplier in which the targets are accommodated to make the pressure in the target supplier be a set pressure value;

an imaging part configured to image two adjacent droplets sequentially supplied into the chamber to output a piece of image data of the two adjacent droplets; and a controller configured to calculate a distance between the two adjacent droplets by using the piece of image data, calculate a traveling speed of the droplets based on the distance between the two adjacent droplets and the predetermined generation frequency, and update the set pressure value according to a difference between the traveling speed of the droplets and a targeted traveling speed.

2. An extreme ultraviolet light generation apparatus comprising:

a target supplier configured to sequentially supply targets to a plasma generation region in a chamber as a plurality of droplets, the targets generating extreme ultraviolet light when being irradiated with a laser beam in the chamber;

a pressure regulator configured to regulate a pressure in the target supplier in which the targets are accommodated to make the pressure in the target supplier be a set pressure value;

a timing measurement unit configured to output a droplet passing signal when a droplet of the plurality of droplets passes through a predetermined position between the target supplier and the plasma generation region;

an imaging part configured to image two adjacent droplets sequentially supplied into the chamber to output a piece of image data of the two adjacent droplets; and a controller configured to determine a number of times at which the droplet passing signal is inputted from the timing measurement unit per unit of time as a generation frequency of the droplets, calculate a distance between the two adjacent droplets by using the piece of image data, calculate a traveling speed of the droplets based on the distance between the two adjacent droplets and the determined generation frequency, and update the set pressure value according to a difference between the traveling speed of the droplets and a targeted traveling speed.

3. The extreme ultraviolet light generation apparatus according to claim 1, wherein the pressure regulator includes:

a first valve provided between a gas supply source and the target supplier;

a second valve provided between the target supplier and an exhaust port;

a pressure sensor configured to detect a pressure in the target supplier; and a pressure regulating part configured to control the first valve and the second valve to make the pressure in the target supplier be the set pressure value when the set pressure value is inputted.

4. The extreme ultraviolet light generation apparatus according to claim 3, wherein the gas supply source supplies inert gas to the target supplier.

5. The extreme ultraviolet light generation apparatus according to claim 4, wherein the inert gas includes helium or argon.

6. The extreme ultraviolet light generation apparatus according to claim 1, wherein the controller calculates traveling speeds of the droplets in a plurality of pieces of image data imaged by the imaging part, calculate an average value of the traveling speeds, and controls the pressure regulator based on the average value of the traveling speeds.

7. The extreme ultraviolet light generation apparatus according to claim 6, wherein the controller updates the set pressure value according to a difference between the average value of the traveling speeds and the targeted traveling speed.

8. The extreme ultraviolet light generation apparatus according to claim 1, further comprising a light source part placed to face to the imaging part via a target traveling path between the target supplier and the plasma generation region, the light source part configured to emit pulsed light to the droplets traveling through the target traveling path, wherein the imaging part captures an image of shadows of the droplets irradiated with the pulsed light.

9. The extreme ultraviolet light generation apparatus according to claim 2, wherein the pressure regulator includes:

a first valve provided between a gas supply source and the target supplier;

a second valve provided between the target supplier and an exhaust port;

a pressure sensor configured to detect a pressure in the target supplier; and a pressure regulating part configured to control the first valve and the second valve to make the pressure in the target supplier be the set pressure value when the set pressure value is inputted.

10. The extreme ultraviolet light generation apparatus according to claim 9, wherein the gas supply source supplies inert gas to the target supplier.

11. The extreme ultraviolet light generation apparatus according to claim 10, wherein the inert gas includes helium or argon.

12. The extreme ultraviolet light generation apparatus according to claim 2, wherein the controller calculates traveling speeds of the droplets in a plurality of pieces of image data imaged by the imaging part, calculate an average value of the traveling speeds, and controls the pressure regulator based on the average value of the traveling speeds.

13. The extreme ultraviolet light generation apparatus according to claim 12, wherein the controller updates the set pressure value according to a difference between the average value of the traveling speeds and the targeted traveling speed.

14. The extreme ultraviolet light generation apparatus according to claim 2, further comprising a light source part placed to face to the imaging part via a target traveling path between the predetermined position and the plasma generation region, the light source part configured to emit pulsed light to the droplets traveling through the target traveling path, wherein the imaging part captures an image of shadows of the droplets irradiated with the pulsed light.

15. An extreme ultraviolet light generation method comprising:

regulating a pressure in a target supplier in which targets are accommodated to make the pressure in the target supplier be a set pressure value;

sequentially supplying the targets to a plasma generation region in a chamber as a plurality of droplets at a generation frequency;

imaging two adjacent droplets sequentially supplied into the chamber to acquire a piece of image data of the two adjacent droplets; and calculating a distance between the two adjacent droplets by using the piece of image data, calculating a traveling speed of the droplets based on the distance between the two adjacent droplets and the generation frequency, and updating the set pressure value according to a difference between the traveling speed of the droplets and a targeted traveling speed.

16. The extreme ultraviolet light generation method according to claim 15, wherein:

the calculating the distance between the two adjacent droplets includes calculating distances between the two adjacent droplets in a plurality of pieces of image data;

the calculating the traveling speed of the droplets includes calculating an average value of the traveling speeds of the droplets based on distances between the two adjacent droplets; and the updating the set pressure value includes updating the set pressure value according to a difference between the average value of the traveling speeds and the targeted traveling speed.

17. The extreme ultraviolet light generation method according to claim 15, further comprising:

inputting the set pressure value;

inputting the generation frequency; and inputting the targeted traveling speed.

18. The extreme ultraviolet light generation method according to claim 16, further comprising:

inputting the set pressure value;

inputting the generation frequency; and inputting the targeted traveling speed.

* * * * *